US010905198B2

(12) United States Patent
Smaldone et al.

(10) Patent No.: US 10,905,198 B2
(45) **Date of Patent: *Feb. 2, 2021**

(54) ARTICLE OF FOOTWEAR WITH ADJUSTABLE STIFFNESS

(71) Applicant: NIKE, Inc., Beaverton, OR (US)

(72) Inventors: Patricia L. Smaldone, Portland, OR (US); Stephen D. Pelletier, Jr., Portland, OR (US); Jeremy L. Connell, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/405,485

(22) Filed: May 7, 2019

(65) Prior Publication Data

US 2019/0261743 A1 Aug. 29, 2019

Related U.S. Application Data

(60) Continuation of application No. 15/266,074, filed on Sep. 15, 2016, now Pat. No. 10,292,456, which is a (Continued)

(51) Int. Cl.

| | |
|---|---|
| ***A43C 11/16*** | (2006.01) |
| ***A43B 5/04*** | (2006.01) |
| ***A43C 1/04*** | (2006.01) |

(52) U.S. Cl.

CPC ..... *A43C 11/165* (2013.01); *A43B 5/0401* (2013.01); *A43B 5/0403* (2013.01); (Continued)

(58) Field of Classification Search

CPC ... A43B 5/0405; A43B 5/0401; A43B 5/0454; A43B 5/0452; A43B 5/0456; A43B 5/0458; A43B 5/046; A43C 11/165

See application file for complete search history.

(56) References Cited

U.S. PATENT DOCUMENTS

| | | | |
|---|---|---|---|
| 87,655 | A | 3/1869 | Foster et al. |
| 923,860 | A | 6/1909 | Kroell et al. |

(Continued)

FOREIGN PATENT DOCUMENTS

| | | | |
|---|---|---|---|
| DE | 4129270 | A1 | 3/1993 |
| DE | 202008000952 | U1 | 3/2008 |
| EP | 2042050 | A1 | 4/2009 |

OTHER PUBLICATIONS

Final Office Action dated Apr. 12, 2016 in U.S. Appl. No. 13/939,213.

(Continued)

*Primary Examiner* — Ted Kavanaugh

(74) *Attorney, Agent, or Firm* — Honigman LLP; Matthew H. Szalach; Jonathan P. O'Brien

(57) ABSTRACT

An article of footwear with adjustable stiffness is provided. The article of footwear in the form of a snowboard boot is provided with adjustable tensioning systems that are disposed on either side of an inner liner of the snowboard boot. The adjustable tensioning system includes a comb body structure having flex portions made of a plurality of extending fingers with a flexibility that can be controlled by the adjustable tensioning system. Depending on the level of tension applied by the tensioning system, or lack thereof, a range of flex profiles having varying amounts of stiffness are available to the wearer to adjust the overall stiffness of the snowboard boot.

18 Claims, 32 Drawing Sheets

Related U.S. Application Data division of application No. 13/939,210, filed on Jul. 11, 2013, now Pat. No. 9,474,324.

(60) Provisional application No. 61/734,751, filed on Dec. 7, 2012.

(52) U.S. Cl.
CPC ..... *A43B 5/0405* (2013.01); *A43B 5/046* (2013.01); *A43B 5/0415* (2013.01); *A43B 5/0435* (2013.01); *A43C 1/04* (2013.01)

(56) References Cited

U.S. PATENT DOCUMENTS

| | | | |
|---|---|---|---|
| 3,738,025 | A | 6/1973 | Hanson et al. |
| 3,968,578 | A | 7/1976 | Rathmell et al. |
| 4,043,059 | A | 8/1977 | Rathmell et al. |
| 4,583,306 | A | 4/1986 | Paris et al. |
| 4,843,740 | A | 7/1989 | Walkhoff et al. |
| 4,937,951 | A | 7/1990 | Loecker et al. |
| 4,937,953 | A | 7/1990 | Walkhoff et al. |
| 5,181,331 | A | 1/1993 | Berger et al. |
| 5,265,353 | A | 11/1993 | Marega et al. |
| 5,339,545 | A | 8/1994 | Paris et al. |
| 5,575,090 | A | 11/1996 | Condini |
| 5,829,169 | A | 11/1998 | James et al. |
| 6,119,374 | A | 9/2000 | Bollard et al. |
| 6,128,837 | A | 10/2000 | Huang |
| 6,360,454 | B1 | 3/2002 | Dachgruber et al. |
| 6,381,877 | B2 | 5/2002 | Filice et al. |
| 6,796,058 | B2 | 9/2004 | Pochatko et al. |
| 6,935,054 | B2 | 8/2005 | Hall et al. |
| 7,290,355 | B2 | 11/2007 | Labonte et al. |
| 7,540,100 | B2 | 6/2009 | Pawlus et al. |
| 7,810,258 | B2 | 10/2010 | Narajowski et al. |
| 7,992,326 | B2 | 8/2011 | Trinkaus et al. |
| 8,234,798 | B2 | 8/2012 | Dibenedetto et al. |
| 8,321,984 | B2 | 12/2012 | Dojan et al. |
| 9,474,324 | B2 | 10/2016 | Smaldone et al. |
| 2001/0042324 | A1 | 11/2001 | Filice et al. |
| 2002/0092205 | A1 | 7/2002 | Hall et al. |
| 2004/0074110 | A1 | 4/2004 | Borsoi et al. |
| 2004/0200098 | A1 | 10/2004 | Martin et al. |
| 2004/0244221 | A1 | 12/2004 | Hall et al. |
| 2004/0250452 | A1 | 12/2004 | Farys et al. |
| 2005/0066546 | A1 | 3/2005 | Elkington et al. |
| 2005/0204585 | A1 | 9/2005 | Loveridge et al. |
| 2005/0205585 | A1 | 9/2005 | Chiu et al. |
| 2006/0037215 | A1 | 2/2006 | Lee et al. |
| 2006/0196083 | A1 | 9/2006 | Martin et al. |
| 2010/0139057 | A1 | 6/2010 | Soderberg et al. |
| 2010/0175278 | A1* | 7/2010 | Seliger ..... A43C 3/00 36/117.1 |
| 2011/0088285 | A1 | 4/2011 | Dojan et al. |
| 2011/0214313 | A1 | 9/2011 | James et al. |
| 2012/0167418 | A1 | 7/2012 | Frappier et al. |
| 2014/0115928 | A1 | 5/2014 | Pelletier, Jr. et al. |
| 2017/0354206 | A1* | 12/2017 | Hammerslag ..... A43C 11/00 |
| 2020/0077748 | A1* | 3/2020 | Dyer ..... A43C 11/165 |

OTHER PUBLICATIONS

International Preliminary Report on Patentability and Written Opinion of the International Searching Authority for International Application No. PCT/US2013/073211, dated Jun. 9, 2015.
International Search Report and Written opinion for Application No. PCT/US2013/073211, dated Apr. 29, 2014, 6 pages.
International Search Report and Written opinion for Application No. PCT/US2013/073260, dated Apr. 10, 2014, 12 pages.
Notice of Allowance dated Jul. 22, 2016 for U.S. Appl. No. 13/939,213.
Office Action dated Oct. 26, 2015 in U.S. Appl. No. 13/939,213.
Response to Restriction Requirement filed Aug. 20, 2015 in U.S. Appl. No. 13/939,213.
Restriction Requirement dated Jun. 23, 2015 in U.S. Appl. No. 13/939,213.
Amendment After Final Rejection filed Jul. 11, 2016 in U.S. Appl. No. 13/939,213.
United States Patent and Trademark Office, Office Action for U.S. Appl. No. 15/266,074, dated Oct. 9, 2018.
United States Patent and Trademark Office, Office Action for U.S. Appl. No. 15/266,074, dated May 24, 2018.

* cited by examiner

ARTICLE OF FOOTWEAR WITH ADJUSTABLE STIFFNESS

CROSS REFERENCE TO RELATED APPLICATIONS

This application is a continuation of and claims the benefit of priority to U.S. application Ser. No. 15/266,074, filed Sep. 15, 2016, which is a division of U.S. Patent Publication Number US2014/0157627, published Jun. 12, 2014 (U.S. application Ser. No. 13/939,210, filed Jul. 11, 2013), which claims the benefit of U.S. Provisional Patent Application No. 61/734,751, filed Dec. 7, 2012, and titled "Article with Adjustable Stiffness," the contents of which are herein incorporated by reference in their entirety.

BACKGROUND

The present embodiments relate generally to an article of footwear, and more specifically, to an article of footwear in the form of a snowboard boot with adjustable stiffness.

Articles of footwear for snowboarding or skiing have been previously proposed. A wearer may desire articles of footwear having different amounts of stiffness for different types of snowboarding or skiing activities. For example, slopestyle snowboarding events typically require a wearer to navigate down a slope between different jumps, obstacles, etc. In order to facilitate increased maneuverability, a wearer may want to select boots that have some flexibility. In contrast, for example, in half-pipe snowboarding events, a wearer may prefer to select boots that have a great deal of stiffness to efficiently transfer force from the foot/leg to the bindings and snowboard.

There exists a need in the art for an article of footwear that is configured with adjustable stiffness to suit the degree or amount of stiffness desired by a wearer.

SUMMARY

In one aspect, the embodiments provide an article of footwear comprising: an outer shell, the outer shell including an upper and a sole structure; an inner liner, the inner liner being configured to be removably inserted within an interior of the outer shell; an adjustable tensioning system disposed on at least one of a lateral side and a medial side of the inner liner; the adjustable tensioning system including a tensioning element disposed through a body structure and a tension control device attached to the tensioning element; and wherein the tension control element is configured to adjust tension applied to the tensioning element so as to adjust a stiffness of the body structure.

In another aspect, the embodiments provide an adjustable tensioning system for an article of footwear comprising: a tension control device; a tensioning element, the tensioning element having a first end that is attached to the tension control device; a body structure, the body structure including an interior channel disposed along a longitudinal direction of the body structure; wherein the tensioning element is disposed through the interior channel in the body structure and is attached to an anchor at a second end of the tensioning element; and wherein the body structure is disposed along at least one of a medial side and a lateral side of the article of footwear.

In another aspect, the embodiments provide an article of footwear comprising: an outer shell, the outer shell including an upper and a sole structure; an inner liner, the inner liner being configured to be removably inserted within an interior of the outer shell; at least one adjustable tensioning system disposed along one of a lateral side and a medial side of the inner liner, the at least one adjustable tensioning system comprising: a tension control device; a tensioning element, the tensioning element having a first end that is attached to the tension control device; a body structure attached to one of the lateral side and the medial side of the inner liner, the body structure including an interior channel disposed along a longitudinal direction of the body structure; wherein the tensioning element is disposed through the interior channel in the body structure and is attached to an anchor at a second end of the tensioning element; and wherein the at least one adjustable tensioning system is configured to adjust the stiffness of one of the lateral side and the medial side of the article of footwear by adjusting the tension applied to the tensioning element using the tension control device.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
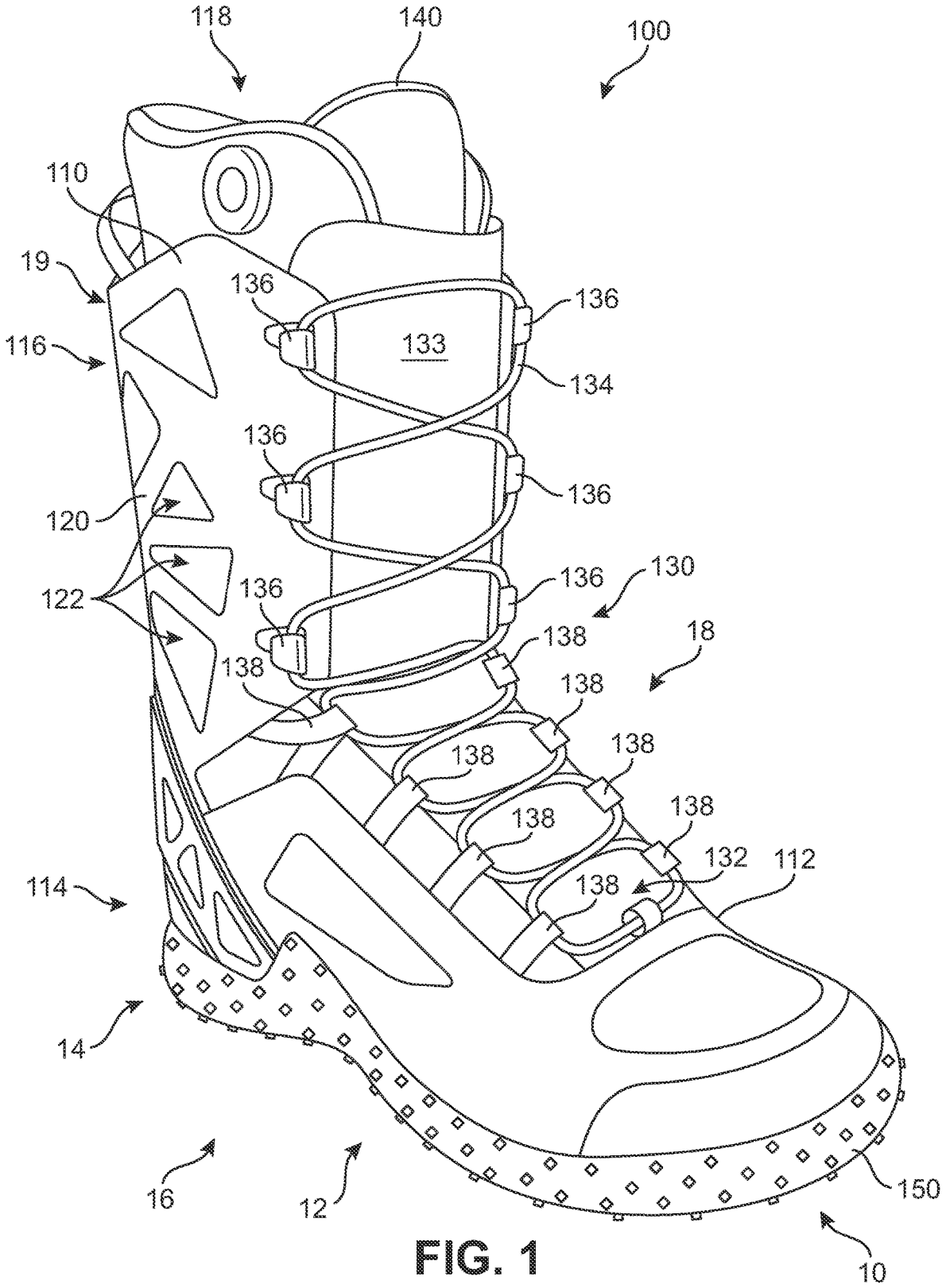
FIG. 1 is an isometric view of an exemplary embodiment of an article of footwear.
Figure 2:
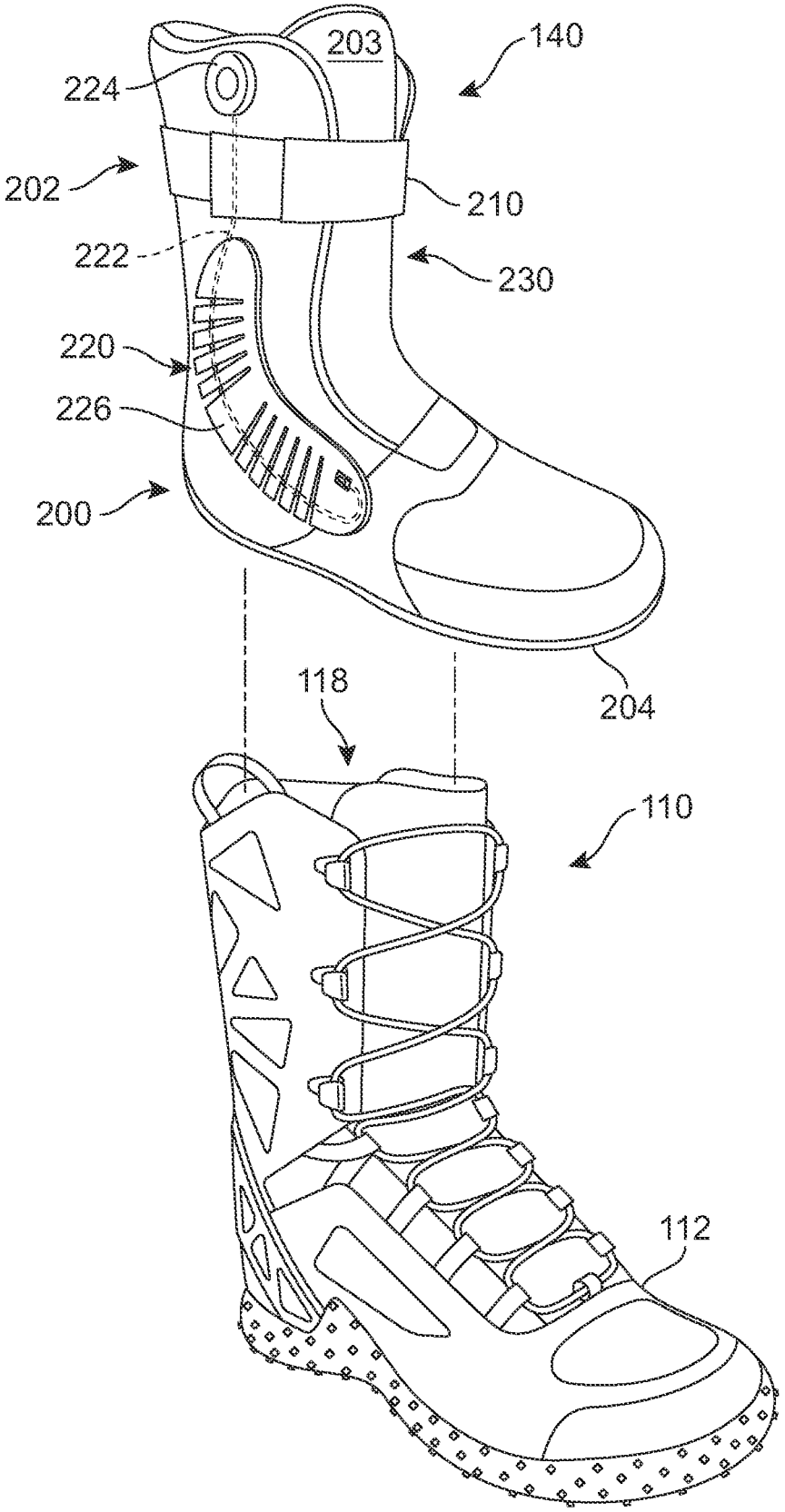
FIG. 2 is an exploded isometric view of an exemplary embodiment of an article of footwear.

FIGS. 1 and 2 illustrate an exemplary embodiment of article of footwear 100. In particular, FIG. 1 illustrates an isometric view of an exemplary embodiment of article of footwear 100 and FIG. 2 illustrates an exploded isometric view of an exemplary embodiment of article of footwear 100. For clarity, the following detailed description discusses an exemplary embodiment, in the form of a boot, but it should be noted that the present embodiments could take the form of any article of footwear including, but not limited to: soccer shoes, football shoes, sneakers, rugby shoes, baseball shoes as well as other kinds of shoes. Furthermore, the exemplary embodiments illustrate a boot configured to be used for snowboarding, however, in other embodiments the boot could be used for other activities such as skiing, hiking, or any other type of activity in which boots may be used.

As shown in FIGS. 1 and 2, article of footwear 100, also referred to simply as article 100, can be used with a right foot. It is understood that the following discussion may equally apply to a mirror image of article of footwear 100 that can be used with a left foot. Features discussed herein may apply equally well for an article of footwear configured for use with a left foot or for a right foot. However, some features discussed herein or configurations shown may provide particular advantages to an article of footwear configured for use with either a left foot or a right foot, such as a snowboard boot arranged for use as the lead boot for a user having a regular left foot forward stance or a right foot forward "goofy foot" stance.

For purposes of reference, article 100 may be divided into forefoot region 10, midfoot region 12 and heel region 14. Forefoot region 10 may be generally associated with the toes and joints connecting the metatarsals with the phalanges. Midfoot region 12 may be generally associated with the arch of a foot. Likewise, heel region 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot region 10, midfoot region 12 and heel region 14.

It will be understood that forefoot region 10, midfoot region 12 and heel region 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot region 10, midfoot region 12 and heel region 14, as well as lateral side 16 and medial side 18, can also be applied to individual components of an article, such as a sole structure, an upper, and/or an inner liner of the article.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole.

In some embodiments, article 100 may include an outer shell 110 and an inner liner 140. Outer shell 110 and inner liner 140 may be removably associated with one another. In an exemplary embodiment, outer shell 110 may be configured to receive inner liner 140 within an interior of outer shell 110 to form article 100. With this configuration, inner liner 140 may be inserted and removed from outer shell 110.

In some embodiments, outer shell 110 may include an upper 112 and sole structure 150. Sole structure 150 is secured to upper 112 and extends between the foot and the ground when article 100 is worn. In different embodiments, sole structure 150 may include different components. For example, sole structure 150 may include an outsole, a midsole (internal and/or external), and/or an insole. Moreover, in some embodiments, sole structure 150 could include additional internal structures, for example, a midsole with a plate. In some cases, one or more of these components may be optional.

In some embodiments, sole structure 150 may be configured to provide traction for article 100. In addition to providing traction, sole structure 150 may attenuate ground reaction forces when compressed between the foot and the ground during walking, running or other ambulatory activities. The configuration of sole structure 150 may vary significantly in different embodiments to include a variety of conventional or non-conventional structures. In some cases, the configuration of sole structure 150 may be configured according to one or more types of ground surfaces on which sole structure 150 may be used. Examples of ground surfaces include, but are not limited to: natural turf, synthetic turf, dirt, as well as other surfaces.

In embodiments where article of footwear 100 is a snowboard boot, sole structure 150 may include provisions for interacting with a snowboard. For example, in some cases, sole structure 150 may include features for receiving, and fastening to, bindings on a snowboard. Furthermore, sole structure 150 may include traction members to enhance grip between article 100 and a snowboard. For purposes of clarity, sole structure 150 is shown without any particular features for associating with a snowboard, but it will be understood that in different embodiments any such provisions known in the art may be used.

In some embodiments, upper 112 of outer shell 110 may be configured to receive inner liner 140 including a foot of a wearer of article 100. Generally, upper 112 may be any type of upper. In particular, upper 112 could have any design, shape, size and/or color. For example, in embodiments where article 100 is a basketball shoe, upper 112 could be a high top upper that is shaped to provide high support on an ankle. In embodiments where article 100 is a running shoe, upper 112 could be a low top upper. In an exemplary embodiment, upper 112 has the shape of a boot upper that completely covers a foot and provides additional coverage at an ankle.

In an exemplary embodiment, upper 112 of outer shell 110 may be provided with a lower portion 114 and an upper portion 116. In some cases, lower portion 114 may be associated with, and configured to receive, the toes, arch and heel of a foot. Upper portion 116 may extend upwards from lower portion 114. In some cases, upper portion 116 may be associated with an ankle of a foot. In an exemplary embodiment, upper portion 116 may be a cuff portion for upper 112 of outer shell 110.

Upper 112, including both lower portion 114 and upper portion 116, may define a void in article 100 for receiving and securing inner liner 140 including a foot relative to sole structure 150. In particular, the void is shaped to accommodate inner liner 140 including a foot and extends along the lateral side of the foot, along the medial side of the foot, over the foot and under the foot. In some cases, outer shell 110 may be provided with an entry hole 118 that provides access to the void within upper 112. In an exemplary embodiment, entry hole 118 may be provided at a top end of upper portion 116.

Outer shell 110 may include a variety of provisions to facilitate support and/or comfort. For example, some embodiments of outer shell 110 may incorporate a lattice structure 120 disposed along lateral side 16 and medial side 18 and further disposed around a rearward side 19 between lateral side 16 and medial side 18. In some embodiments, portions of outer shell 110 may include a plurality of openings 122 that are spaced in a manner to form lattice structure 120. In one embodiment, for example, openings 122 have an approximately triangular shape, though other embodiments may incorporate openings having any other shapes and/or sizes. In some case, lattice structure 120 disposed on portions of outer shell 110 may help reduce weight while maintaining strength for article 100.

Article 100 may include lacing system 130 for purposes of adjusting upper 112. In some cases, lacing system 130 may extend from forefoot region 10 through midfoot region 12 of article 100. Furthermore, in some cases, lacing system 130 may extend through lower portion 114 and upper portion 116 of upper 112. In particular, lacing system 130 may be associated with a lacing region or gap 132 that is disposed between lateral side 16 and medial side 18 of upper 112.

In some embodiments, upper 112 may include a tongue 133 that extends through lacing region 132 of upper 112. In some cases, tongue 133 may be integrally formed with upper 112. In other cases, however, tongue 133 may be a separate component from upper 112 and may be attached to upper 112 using conventional methods such as stitching or adhesives. In some cases, tongue 133 may include padding or other cushioning material to provide comfort to a foot of a wearer of article 100. Moreover, in different embodiments, tongue 133 could be made of a variety of different materials, including, but not limited to: various kinds of foam including EVA foam, plastics, composite materials (i.e., carbon fiber composite materials, glass reinforced composite materials, etc.). Some embodiments could include a tongue made from any of the materials disclosed in Smaldone, U.S. Patent Application Publication Number US2014/0157625, published Jun. 12, 2014, (U.S. patent application Ser. No. 13/939,213, filed Jul. 11, 2013), titled "Article with Adjustable Stiffness Tongue" and hereby referred to as the adjustable stiffness tongue case, the entirety of which is hereby incorporated by reference.

In some embodiments, lacing system 130 may include lacing member 134. The term "lacing member", as used throughout this detailed discussion, refers to any type of lace that may be used with an article of footwear. Generally, the size, including cross sectional shape and length, of lacing member 134 may be varied. Also, lacing member 134 may be made of any material, including, but not limited to: various types of natural and/or synthetic fibers, steel, nylon, Spectra®/Dyneema®, as well as other types of materials that may be used as laces. Furthermore it should be understood that although a single lacing member is shown in this preferred embodiment, other embodiments may incorporate more than one lace.

In some embodiments, lacing system 130 may include provisions for securing lacing member 134 to various portions of upper 112 and outer shell 110. In some embodiments, lacing system 130 may include lace receiving members configured to receive portions of lacing member 134. In other words, these lace receiving members may function in a similar manner to traditional eyelets. In different embodiments, different types of lace receiving members may be used. Examples of different lace receiving members include but are not limited to: eyelets, hooks, lace loops, lace guides, as well as other types of lace receiving members.

In some embodiments, lacing system 130 may include lace hook members 136. In particular, lace hook members 136 may include a plurality of lace hook members disposed on either side of lacing gap 132 along a medial edge and a lateral edge of upper portion 116 of upper 112 on outer shell 110. In an exemplary embodiment, lace hook members 136 may be traditional types of lace hooks. Generally, lace hooks of lace hook members 136 may have any shape that is configured to receive lacing member 134 for the purposes of tightening the medial edge and the lateral edge on opposite sides of lacing gap 132 on upper portion 116 of upper 112. It will be understood that in other embodiments, different types of lace receiving members could be used in place of lace hooks.

In some embodiments, lacing system 130 may further include lace loop members 138. In particular, lace loop members 138 may include a plurality of lace loop members disposed on either side of lacing gap 132 along a medial edge and a lateral edge of lower portion 114 of upper 112 on outer shell 110. In an exemplary embodiment, lace loops of lace loop members 138 may have any shape that is configured to receive lacing member 134 for the purposes of tightening the medial edge and lateral edge on opposite sides of lacing gap 132 on lower portion 114 of upper 112. It will be understood that in other embodiments, different types of lace receiving members could be used in place of lace loops.

In different embodiments, the materials used for the various components of article 100 may vary. For example, sole structure 150 may be made from any suitable material, including, but not limited to: elastomers, siloxanes, natural rubber, other synthetic rubbers, aluminum, steel, natural leather, synthetic leather, or plastics. In some cases, the materials used for making sole structure 150 may be selected to accomplish stability and cushioning for a foot undergoing forces typically associated with snowboarding.

Also, outer shell 110 and/or upper 112 may be made from any suitable material. Examples of materials for outer shell 110 and/or upper 112 include, but are not limited to: fiberglass, nylon, natural leather, synthetic leather, natural rubber or synthetic rubber, urethane, plastics and polymers, mesh or fabric layers, and/or other suitable materials used in footwear construction. In some cases, outer shell 110 and/or upper 112 may be made of any suitable knitted, woven or non-woven material. In an exemplary embodiment, outer shell 110 and/or upper 112 may be made of a combination of layers. For example, in some cases, outer shell 110 and/or upper 112 may be provided with an outer layer made of synthetic leather, which can enhance the durability of upper 112. The outer layer can be reinforced on an interior side of upper 112 by an inner layer made of, for example, a synthetic fabric that provides padding and/or insulation. It will be understood that outer shell 110 and upper 112 may be made of substantially different materials in some embodiments. Moreover, the material structure of outer shell 110 and/or upper 112 could be associated with any of the materials, and/or method of making the materials, disclosed in the following documents: Dojan, U.S. Patent Application Publication Number 2011/0088285, now U.S. patent application Ser. No. 12/603,494, filed Oct. 21, 2009, and entitled "Composite Shoe Upper and Method of Making Same"; and Dojan, U.S. Pat. No. 8,321,984, filed Oct. 21, 2009 and also titled "Composite Shoe Upper and Method of Making Same," each document being incorporated by reference in their entirety herein.

In an exemplary embodiment, article 100 may include inner liner 140 that is configured to be inserted into entry hole 118 within the interior of outer shell 110 to fill the void defined by upper 112. Inner liner 140 may be made from any suitable material. Examples of materials for inner liner 140 include, but are not limited to: nylon, cotton, polyester, natural and/or synthetic fibers or blends, as well as any of the materials used for upper 112, including natural leather, synthetic leather, natural or synthetic rubber, plastics and polymers, and/or other suitable materials used in footwear construction. In some cases, inner liner 140 may be made of any suitable knitted, woven or non-woven material, including foams or combinations of foams. In an exemplary embodiment, inner liner 140 may be made of a combination of materials. In some cases, inner liner 140 may be made of a material that is configured to provide comfort to a foot of a wearer when disposed within article 100. In an exemplary embodiment, inner liner 140 may be made of a combination of layers. For example, in some cases, inner liner 140 may be provided with an outer layer that is configured to be disposed along the inside of outer shell 110 and an inner layer that is configured to be disposed within the interior of inner liner 140.

Referring now to FIG. 2, an exploded view of article 100, including outer shell 110 and inner liner 140 is illustrated. In this embodiment, inner liner 140 may be seen removably disposed from within the interior of outer shell 110. As discussed above, in some embodiments, inner liner 140 may be inserted and withdrawn from outer shell 110 through entry hole 118.

In an exemplary embodiment, inner liner 140 may have a corresponding shape as outer shell 110. For example, in cases where outer shell 110 and/or upper 112 is configured to be a low top upper, inner liner 140 may have a similar shape. In this embodiment, where outer shell 110 and/or upper 112 is a boot, inner liner 140 may have a corresponding shape. In an exemplary embodiment, inner liner 140 may be provided with a lower liner portion 200 and an upper liner portion 202. In some cases, lower liner portion 200 may be associated with, and configured to receive, the toes, arch and heel of a foot. Upper liner portion 202 may extend upwards from lower liner portion 200. In some cases, upper liner portion 202 may be associated with an ankle of a foot. In an exemplary embodiment, upper liner portion 202 may be a cuff portion for inner liner 140.

In an exemplary embodiment, inner liner 140 may include a bottom 204 disposed on lower liner portion 200. Bottom 204 of inner liner 140 may be configured to rest along the bottom interior of outer shell 110 inside of upper 112. In some cases, bottom 204 may be made of a different material from the rest of inner liner 140 that is configured to provide traction or friction with the interior of outer shell 110. In other cases, bottom 204 may be treated with an applied coating or material to increase the traction or friction with the interior of outer shell 110. In some embodiments, bottom 204 may comprise various distinct structures, for example, a plate may be integrated into a portion of bottom 204. In still further embodiments, bottom 204 may include various kinds of textures or other surface features that may enhance traction. In one embodiment, bottom 204 may include a rubberized coating.

In some embodiments, inner liner 140 may include a tongue 203 that extends through upper liner portion 202 and into a portion of lower liner portion 200. In an exemplary embodiment, tongue 203 may correspond approximately to lacing region 132 of upper 112. In some cases, tongue 203 may be integrally formed with inner liner 140. In other cases, however, tongue 203 may be a separate component from inner liner 140 and may be attached to inner liner 140 using conventional methods such as stitching or adhesives. In some cases, tongue 203 may include padding or other cushioning material to provide comfort to a foot of a wearer of article 100.

In some embodiments, inner liner 140 may be provided with a fastening member 210. Fastening member 210 may be a strap or other mechanism that is configured to tighten upper liner portion 202 of inner liner 140 on a foot of a wearer. In an exemplary embodiment, fastening member 210 may be secured to inner liner 140 on a first side and may be adjustably secured to an anchor disposed on the exterior of inner liner 140 on a second side to allow fastening member 210 to be drawn tight. In one embodiment, fastening member 210 may include hook and loop fasteners to hold fastening member 210 in a closed position on inner liner 140. In other embodiments, other tightening or fastening mechanisms may be used to tighten inner liner 140 around a foot of a wearer.

Figure 23:
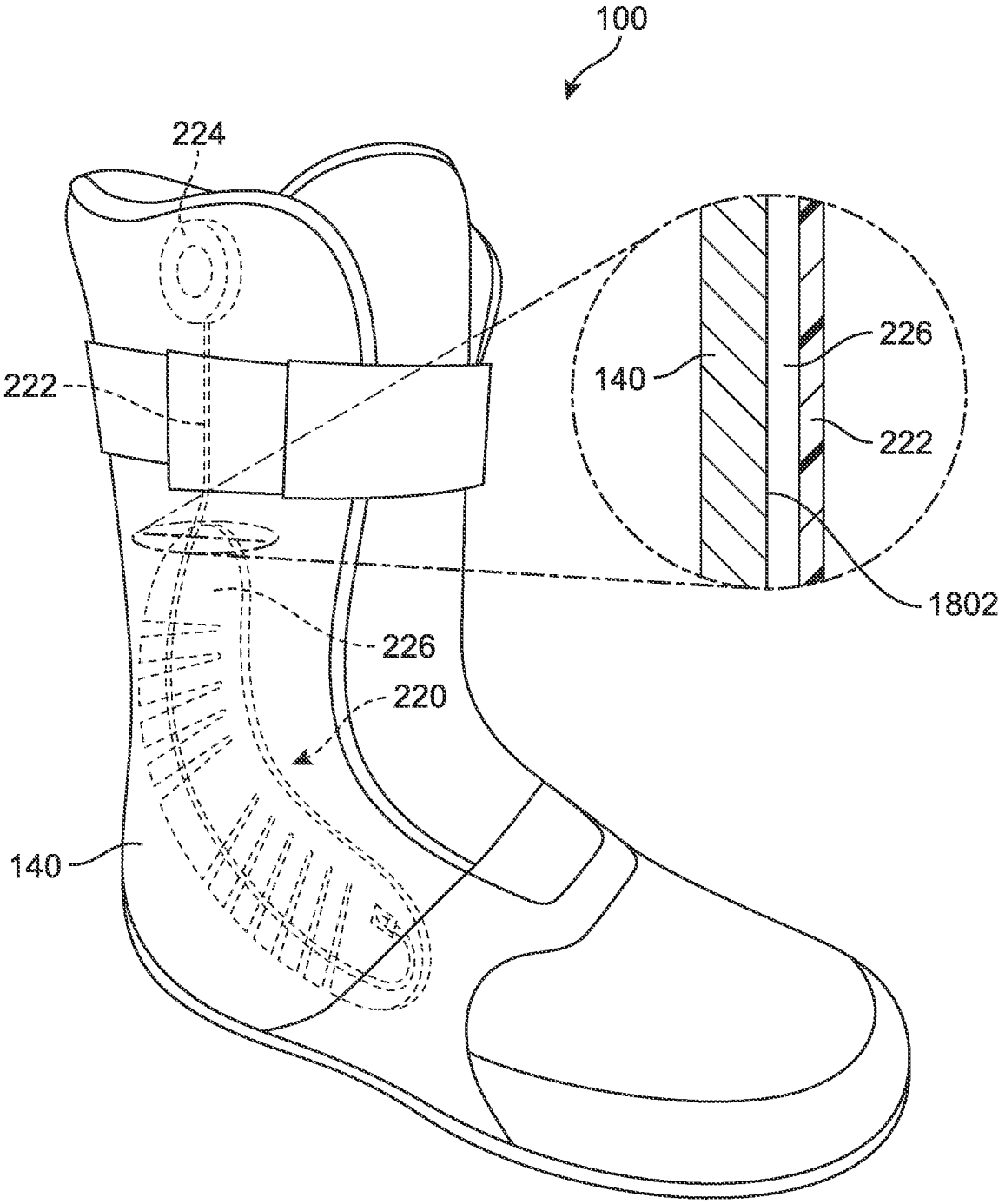
FIG. 23 is a schematic isometric view of an alternative configuration for an article, in which the tensioning system is disposed along an inner side of an inner liner.
Figure 24:
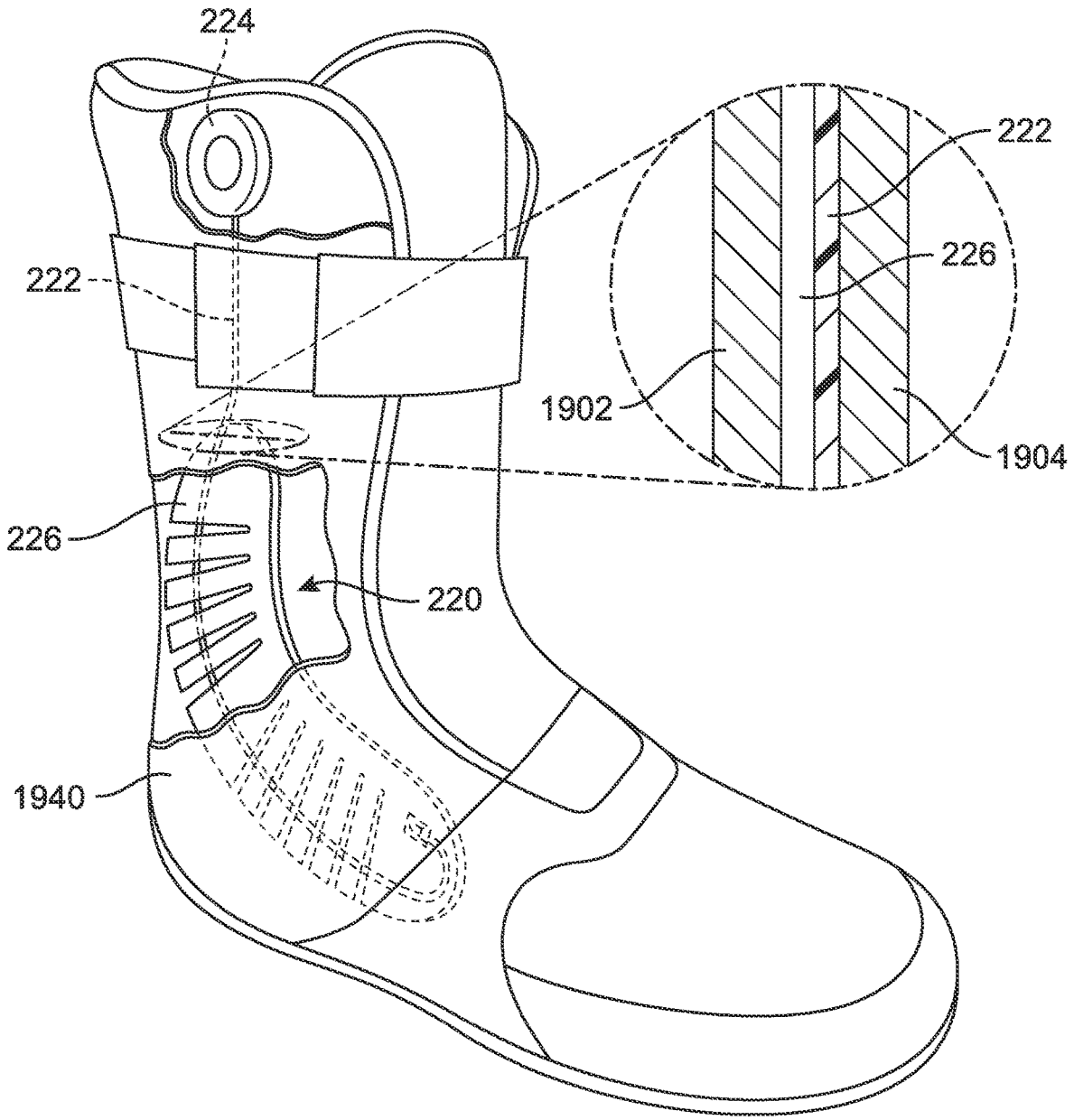
FIG. 24 is a schematic isometric view of an alternative configuration for an article, in which the tensioning system is disposed between an outer layer and an inner layer of an inner liner.
Figure 25:
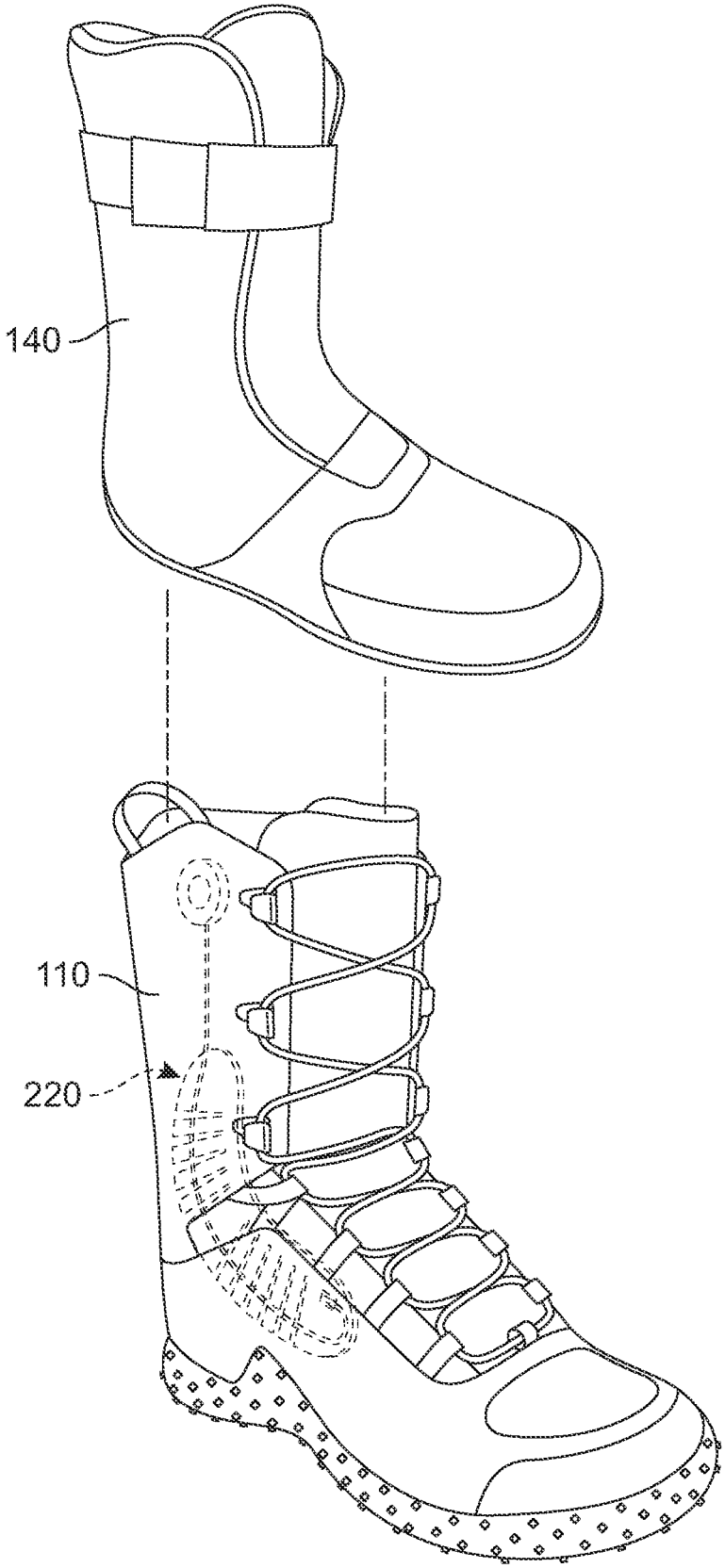
FIG. 25 is a schematic isometric view of an alternative configuration for an article, in which the tensioning system is disposed along an inner side of an outer shell.

In some embodiments, article 100 may be provided with components that are configured to provide adjustable stiffness and flexibility to a wearer. In an exemplary embodiment, inner liner 140 may include one or more adjustable tensioning systems disposed along inner liner 140 through a portion of upper liner portion 202 and/or lower liner portion 200 along each of lateral side 16 and medial side 18. In one embodiment, the adjustable tensioning systems may be provided on the exterior surface of inner liner 140. In other embodiments, however, the adjustable tensioning systems may be disposed between one or more layers of inner liner 140. For example, FIGS. 23 through 25 show examples of alternative locations for adjustable tensioning systems within article 100. In particular, FIG. 23 illustrates a configuration in which lateral tensioning system 220 is disposed along an interior side 1802 of inner liner 140, which may comprise a single layered liner in this embodiment. In particular, the various components of tensioning system 220, including body structure 226, tensioning cable 222 and tension control device 224 may be disposed inwardly of interior side 1802. In still another configuration, shown in FIG. 24, lateral tensioning system 220 is disposed between an outer layer 1902 and an inner layer 1904 of inner liner 1940. In particular, for example, body structure 226, tensioning cable 222 and tension control device 224 are each disposed between outer layer 1902 and inner layer 1904. In still another configuration, shown in FIG. 25, components of tensioning system 220 could be attached to an interior side of outer shell 110, rather than to being attached to portions of inner liner 140.

Referring again to FIG. 2, in this embodiment, inner liner 140 includes a lateral tensioning system 220 disposed on lateral side 16 of inner liner 140. Inner liner 140 may also include a medial tensioning system 230 disposed on medial side 18 of inner liner 140, opposite lateral tensioning system 220. In an exemplary embodiment, adjustable tensioning systems, including lateral tensioning system 220 and/or medial tensioning system 230, may be provided on inner liner 140 to allow a wearer to adjust the amount or degree of stiffness and/or flexibility of article 100 when worn by the wearer, as described in more detail below.

Figure 3:
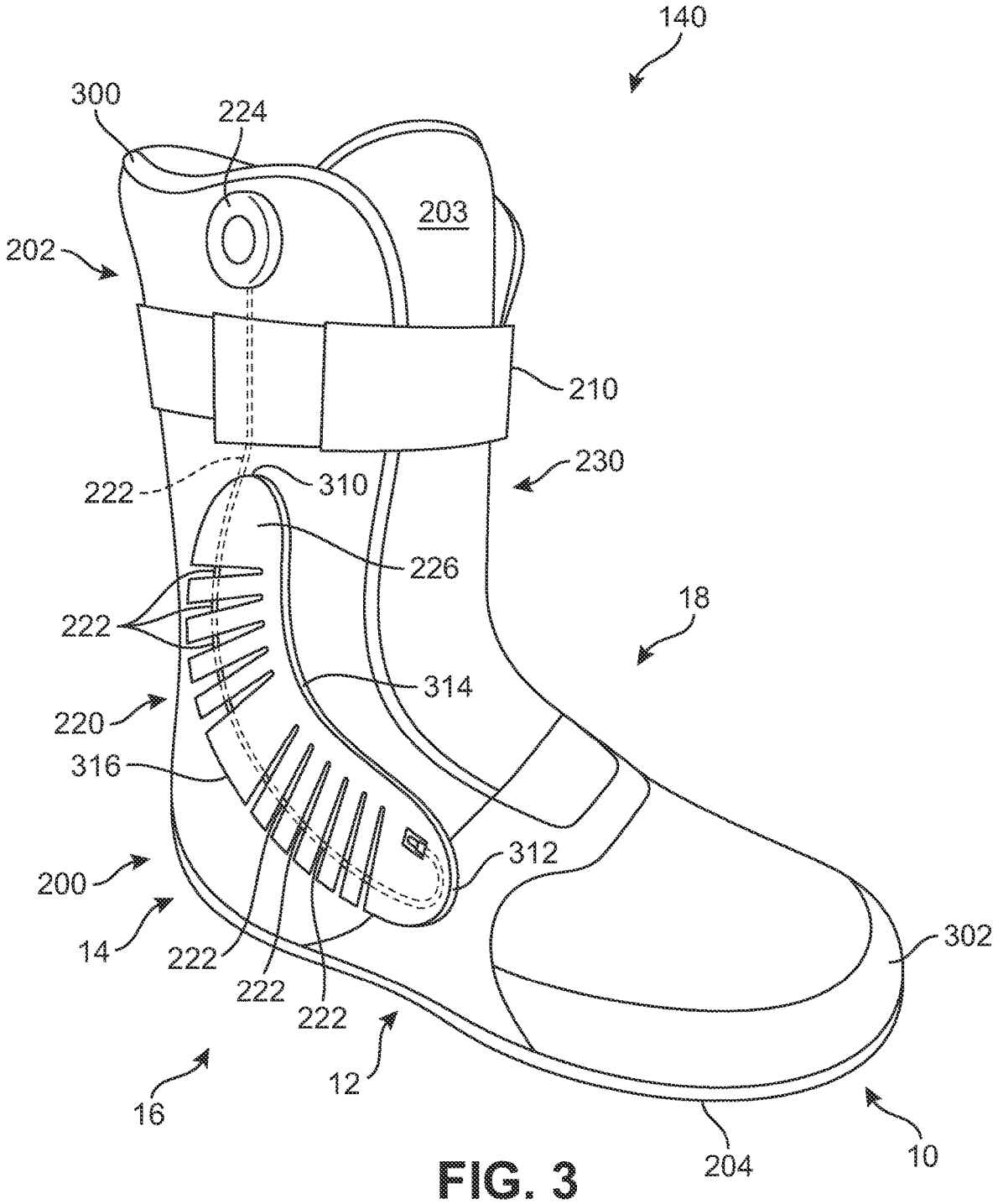
FIG. 3 is a lateral isometric view of an exemplary embodiment of an inner liner for an article of footwear having an adjustable tensioning system.

FIG. 3 illustrates a lateral isometric side view of inner liner 140. In some embodiments, inner liner 140 may be configured for insertion into outer shell 110 to form a boot. In an exemplary embodiment, inner liner 140 may be provided with adjustable tensioning systems, including lateral tensioning system 220 and medial tensioning system 230, disposed on opposite sides of inner liner 140. In some embodiments, lateral tensioning system 220 may include a number of components. In an exemplary embodiment, lateral tensioning system 220 may include provisions for controlling and/or limiting the flexibility of lateral side 16 of inner liner 140. Although the current embodiment illustrates tensioning systems on the lateral and medial sides of inner liner 140, in other embodiments tensioning systems could be provided only on the lateral side or only on the medial side. Furthermore, in further embodiments tensioning systems could be provided in additional locations, such as for example, the tongue. An article including a tongue with a tensioning system can be found in the adjustable stiffness tongue case cited above. Moreover, in some embodiments, an article could include tensioning systems disposed on the lateral and medial sides of an article as well as on a tongue.

Lateral tensioning system 220 may include various different components including, for example, a body structure, a tensioning element and a tension control device. A body structure may be any rigid or semi-rigid member disposed on or in inner liner 140 that is configured to undergo various amounts of flexing depending on the tension applied to the body structure to provide or permit a desired amount of stiffness or flexibility to article 100. In different embodiments, a body structure may have different shapes and/or forms. In some embodiments, a body structure may have a comb-like shape and/or form. In an exemplary embodiment, lateral tensioning element 220 includes a comb body structure 226.

Body structures for the adjustable tensioning systems described herein may be made of any suitable materials. Suitable materials for making body structures may include, but are not limited to: thermoplastic polyurethane (TPU) of various compositions and densities, nylon, elastomers, polymers, urethane, rubber, plastics, wood, metal, carbon fiber, resins, composite materials, and any other rigid or semi-rigid material. In various embodiments, different amounts or levels of stiffness may be provided to an article by varying the materials and/or rigidity of a body structure.

A tensioning element may be any element capable of applying tension to one or more portions of the body structure. Examples of different tensioning elements include, but are not limited to, tensioning rods, tensioning cables, tensioning wires, as well as possibly other components known in the art for applying tension. In some embodiments, lateral tensioning system 220 includes a tensioning cable 222.

Figure 16:
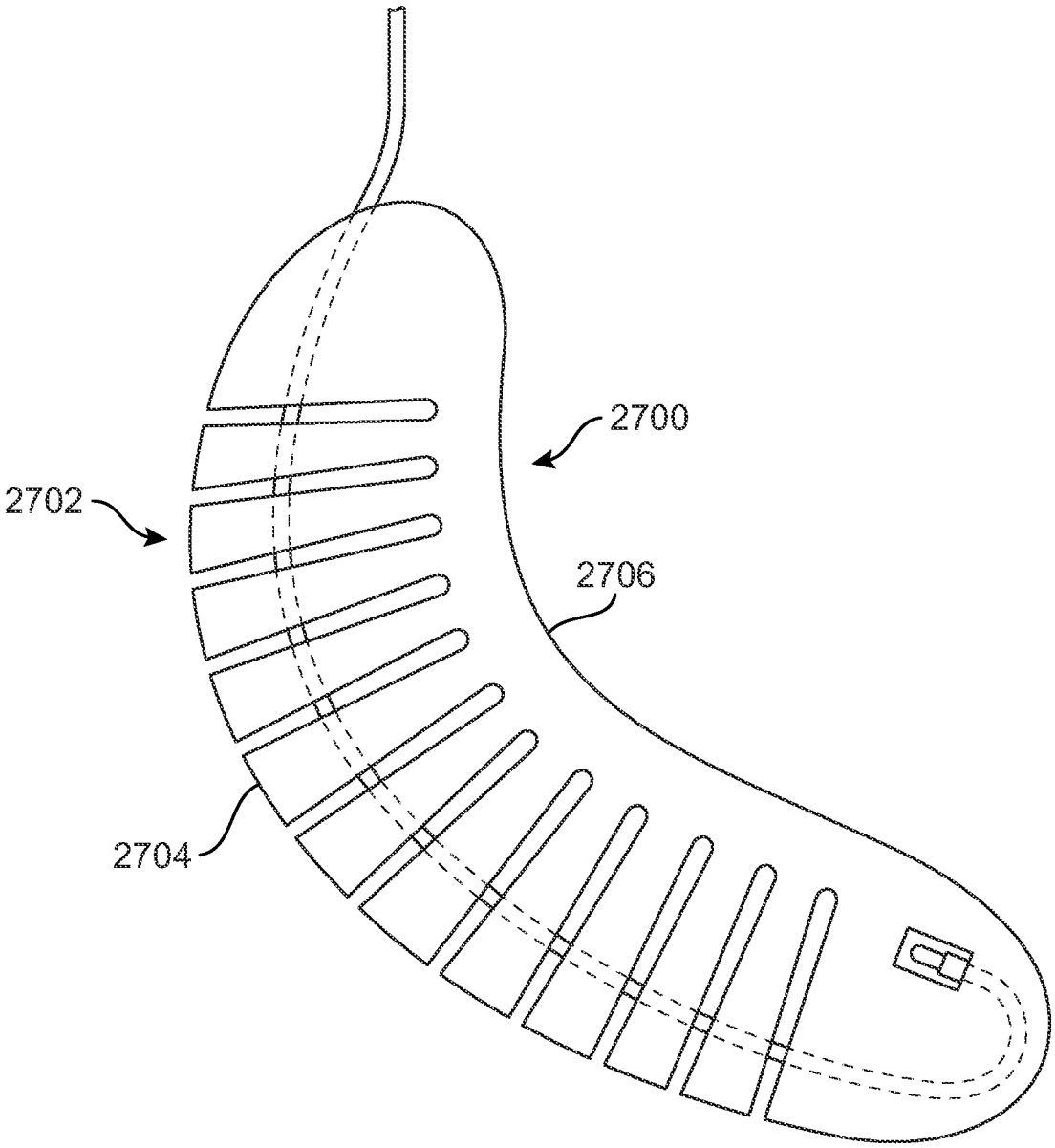
FIG. 16 is a schematic view of an alternative embodiment of a structure for an adjustable tensioning system in a loosened configuration.
Figure 17:
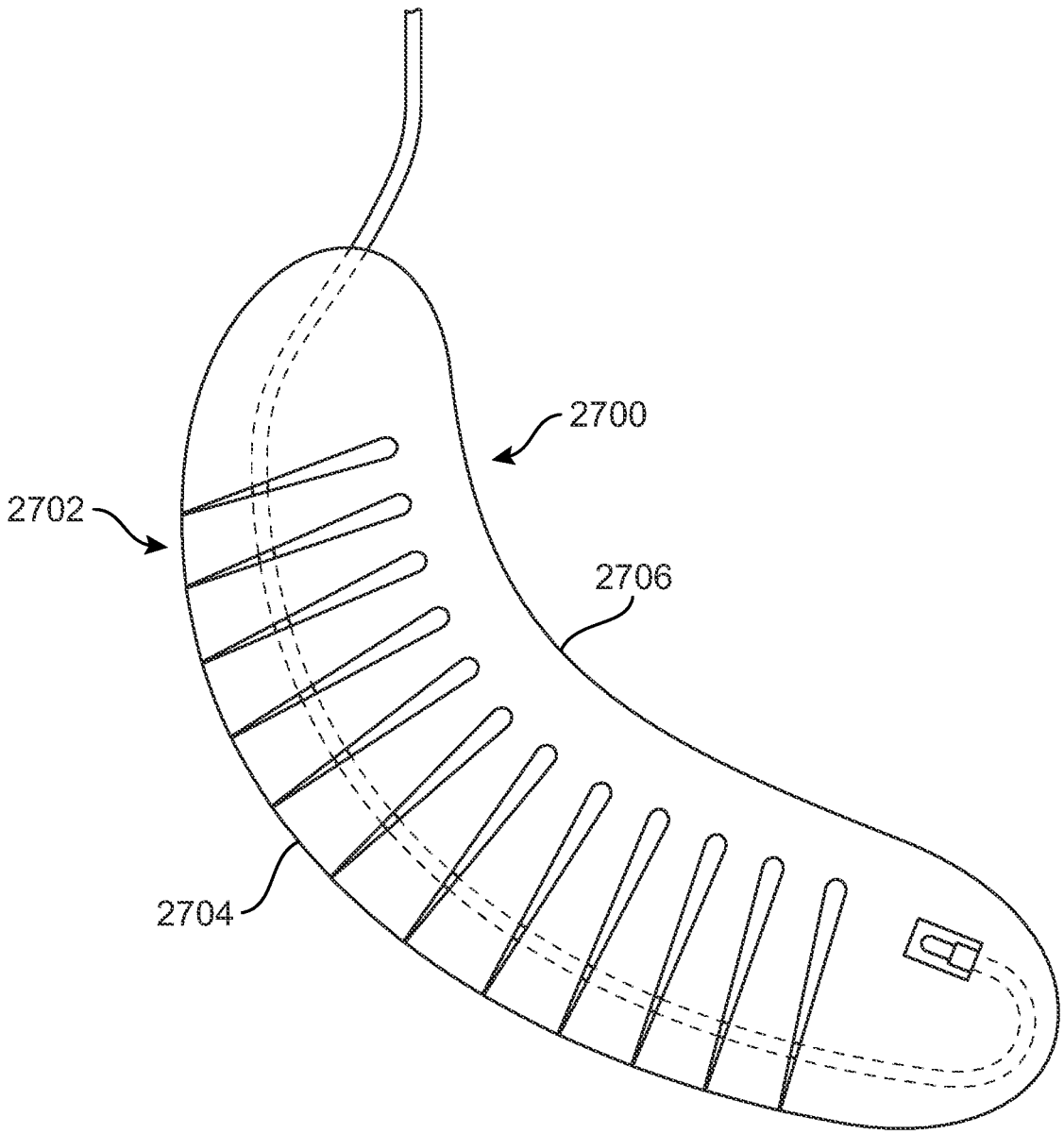
FIG. 17 is a schematic view of the alternative embodiment of FIG. 16 in the tightened configuration.

A tension control device may be any device used to control the tension of the tensioning element disposed through the body structure. Examples of different tension control devices include, but are not limited to: reel devices with a ratcheting mechanism, reel devices with a cam mechanism, manual tensioning devices, automatic tensioning devices, as well as possibly other kinds of tensioning devices. Examples of a tensioning device comprising a reel and ratcheting mechanism that could be used with the current embodiments are disclosed in Soderberg et al., U.S. Patent Application Publication Number 2010/0139057, now U.S. patent application Ser. No. 12/623,362, filed Nov. 20, 2009 and titled "Reel Based Lacing System", the entirety of which is hereby incorporated by reference. Embodiments including devices with a cam mechanism are described below and shown in FIGS. 15 through 17. In some embodiments, lateral tensioning system 220 includes a tension control device 224, which comprises a manually adjusted reel for winding tensioning cable 222 to increase or decrease tension (i.e., tighten or loosen) within comb body structure 226.

In some embodiments, lateral tensioning system 220 may include comb body structure 226 that has a predetermined alignment along the exterior surface of inner liner 140 on lateral side 16. In an exemplary embodiment, lateral tensioning system 220 may be configured so that comb body structure 226 is disposed at least through a portion of upper liner portion 202 and a portion of lower liner portion 200. In addition, in an exemplary embodiment, lateral tensioning system 220 may further be configured so that comb body structure 226 is configured to be disposed through at least a portion of midfoot region 12 and/or heel region 14. In one embodiment, the location of comb body structure 226 may be made to approximately coincide with the location of an ankle of a foot a wearer when disposed within article 100. With this arrangement, comb body structure 226 may be configured to provide stiffness and/or flexibility to assist with support, stability, and/or range of motion of an ankle of a foot within article 100.

In an exemplary embodiment, comb body structure 226 may include a proximal end 310 and a distal end 312 disposed opposite proximal end 310. In an exemplary embodiment, proximal end 310 of comb body structure 226 may be located higher along upper liner portion 202 of inner liner 140 than distal end 312. In this embodiment, proximal end 310 is disposed adjacent to fastening member 210 towards a top end 300 of inner liner 140. Comb body structure 226 extends along the exterior of inner liner 140 from proximal end 310 down to distal end 312 disposed beneath proximal end 310. Additionally, distal end 312 is disposed forward of proximal end 310 in a direction towards a toe end 302 of inner liner 140. In this embodiment, distal end 312 of comb body structure 226 is disposed adjacent to bottom 204 within midfoot region 12 of lower liner portion 200 of inner liner 140.

In some embodiments, the shape of comb body structure 226 may be further defined by a leading side 314 and a trailing side 316 that are associated with opposite curvatures. In an exemplary embodiment, one of leading side 314 and trailing side 316 may be associated with a convex curvature and the opposite side may be associated with a concave curvature. In this embodiment, trailing side 316 may be approximately convex and leading side 314 may be approximately concave. With this arrangement, the curvature of comb body structure 226 may be associated with a generally kidney-shaped or bean-shaped appearance.

Tension control device 224 may generally be mounted to a portion of inner liner 140. In one embodiment, tension control device 224 may be mounted to upper liner portion 202 of inner liner 140 adjacent to top end 300. In other embodiments, however, tension control device 224 may be mounted to lower liner portion 200 of inner liner 140. In still other embodiments, tension control device 224 may be mounted to other portions of inner liner 140, including tongue 203. Moreover, tension control device 224 could be mounted on an inner surface or an outer surface of inner liner 140, as well as possibly between layers in cases where inner liner 140 comprises multiple layers. In still further embodiments, tension control device 224 could be mounted to other portions of an article, including portions of outer shell 110. Furthermore, it will be understood that in some embodiments, the location of tension control device 224 may be selected according to the locations of various components of a tensioning system. In some embodiments, inner liner 140 may be configured with mounting provisions, including at least an opening for receiving a portion of tension control device 224. Additionally, in some cases, mounting provisions may include additional provisions such as a flange or raised rim configured to partially surround tension control device 224. Tension control device 224 may be retained in place within inner liner 140 using any kinds of fasteners, adhesives and/or friction fits.

Tensioning cable 222 may be arranged along inner liner 140 in a manner that best facilitates controlling the flexibility of comb body structure 226. To achieve this control, in some embodiments, tensioning cable 222 may generally extend along inner liner 140 between tension control device 224 and comb body structure 226. In an exemplary embodiment, tensioning cable 222 may be disposed between one or more layers of inner liner 140 so that tensioning cable 222 is not disposed along the exterior of inner liner 140. As more fully described in detail below, in an exemplary embodiment, tensioning cable 222 may be disposed through a channel or similar structure within comb body structure 226 so that tensioning cable 222 may extend through a majority of the length of comb body structure 226 between proximal end 310 and distal end 312.

Figure 4:
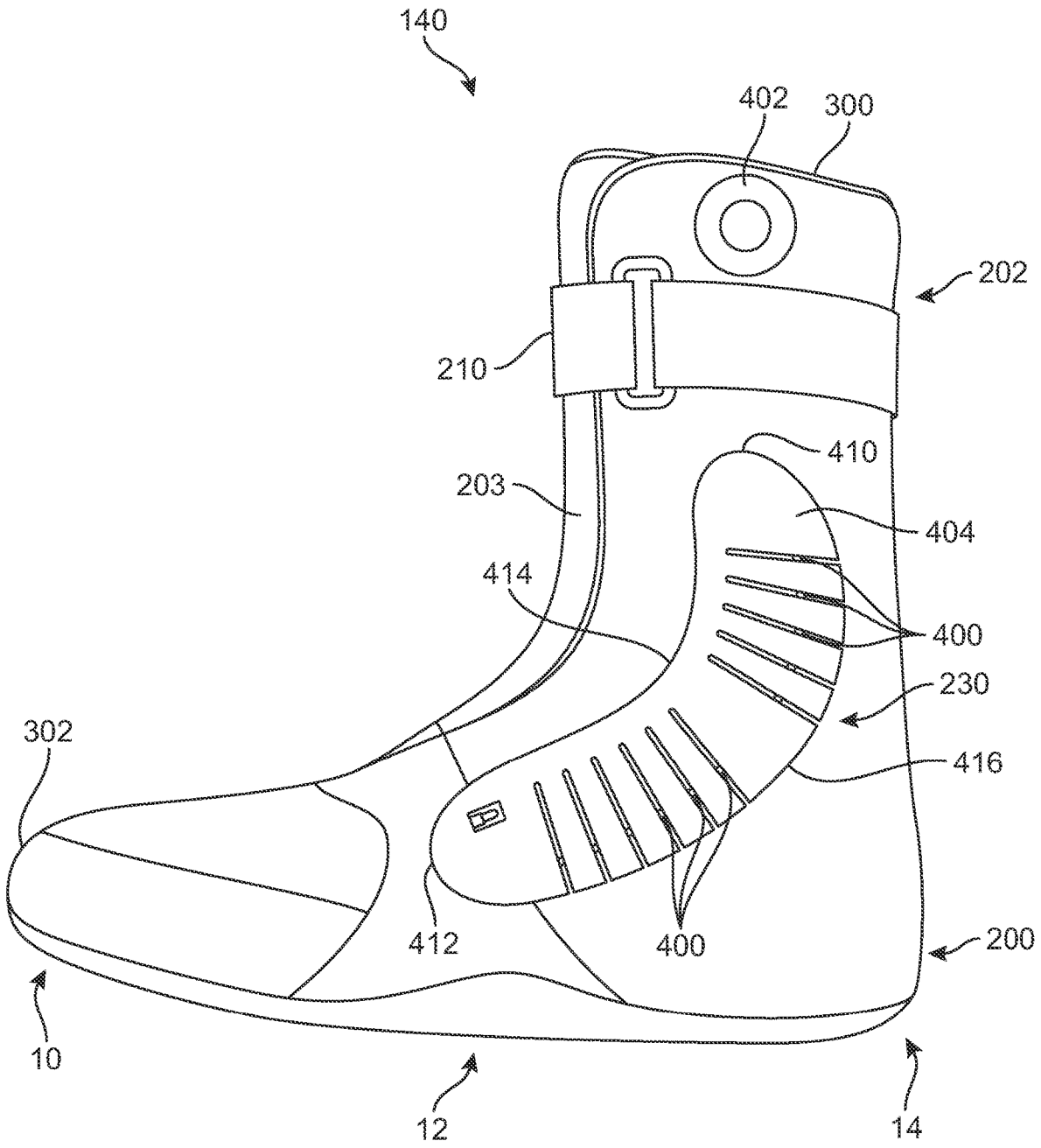
FIG. 4 is a medial side view of an exemplary embodiment of an inner liner for an article of footwear having an adjustable tensioning system.

Referring now to FIG. 4, a medial side view of inner liner 140 is illustrated. In some embodiments, medial tensioning system 230 may have a substantially similar structure as lateral tensioning system 220, described above. In an exemplary embodiment, medial tensioning system 230 may include a body structure, a tensioning element and a tension control device that are substantially similar to the components described above with regard to lateral tensioning system 220. In this embodiment, medial tensioning system 230 includes a tensioning cable 400, a tension control device 402, and a comb body structure 404 disposed on medial side 18 of inner liner 140.

In some embodiments, medial tensioning system 230 may include comb body structure 404 that has a predetermined alignment along the exterior surface of inner liner 140 on medial side 18. In an exemplary embodiment, medial tensioning system 230 may be configured so that comb body structure 404 is disposed at least through a portion of upper liner portion 202 and a portion of lower liner portion 200. In addition, in an exemplary embodiment, medial tensioning system 230 may further be configured so that comb body structure 404 is configured to be disposed through at least a portion of midfoot region 12 and/or heel region 14. In one embodiment, the location of comb body structure 404 may be made to approximately coincide with the location of an ankle of a foot a wearer when disposed within article 100. With this arrangement, comb body structure 404 may be configured to provide stiffness and/or flexibility to assist with support, stability, and/or range of motion of an ankle of a foot within article 100.

In an exemplary embodiment, comb body structure 404 may include a proximal end 410 and a distal end 412 disposed opposite proximal end 410. In an exemplary embodiment, proximal end 410 of comb body structure 404 may be located higher along upper liner portion 202 of inner liner 140 than distal end 412. In this embodiment, proximal end 410 is disposed adjacent to fastening member 210 towards top end 300 of inner liner 140. Comb body structure 404 extends along the exterior of inner liner 140 from proximal end 410 down to distal end 412 disposed beneath proximal end 410. Additionally, distal end 412 is disposed forward of proximal end 410 in a direction towards toe end 302 of inner liner 140. In this embodiment, distal end 412 of comb body structure 404 is disposed adjacent to bottom 204 within midfoot region 12 of lower liner portion 200 of inner liner 140.

In some embodiments, the shape of comb body structure 404 may be further defined by a leading side 414 and a trailing side 416 that are associated with opposite curvatures. In an exemplary embodiment, one of leading side 414 and trailing side 416 may be associated with a convex curvature and the opposite side may be associated with a concave curvature. In this embodiment, trailing side 416 may be approximately convex and leading side 414 may be approximately concave. With this arrangement, the curvature of comb body structure 404 may be associated with a generally kidney-shaped or bean-shaped appearance.

Tension control device 402 may generally be mounted to a portion of inner liner 140. In one embodiment, tension control device 402 may be mounted to upper liner portion 202 of inner liner 140 adjacent to top end 300. In other embodiments, however, tension control device 402 may be mounted to lower liner portion 200 of inner liner 140. In still other embodiments, tension control device 402 may be mounted to other portions of inner liner 140, including tongue 203. In some embodiments, inner liner 140 may be configured with mounting provisions, including at least an opening for receiving a portion of tension control device 402. Additionally, in some cases, mounting provisions may include additional provisions such as a flange or raised rim configured to partially surround tension control device 402. Tension control device 402 may be retained in place within inner liner 140 using any kinds of fasteners, adhesives and/or friction fits.

Tensioning cable 400 may be arranged along inner liner 140 in a manner that best facilitates controlling the flexibility of comb body structure 404. To achieve this control, in some embodiments, tensioning cable 400 may generally extend along inner liner 140 between tension control device 402 and comb body structure 404. In an exemplary embodiment, tensioning cable 400 may be disposed between one or more layers of inner liner 140 so that tensioning cable 400 is not disposed along the exterior of inner liner 140. As more fully described in detail below, in an exemplary embodiment, tensioning cable 400 may be disposed through a channel or similar structure within comb body structure 404 so that tensioning cable 400 may extend through a majority of the length of comb body structure 404 between proximal end 410 and distal end 412.

Figure 5:
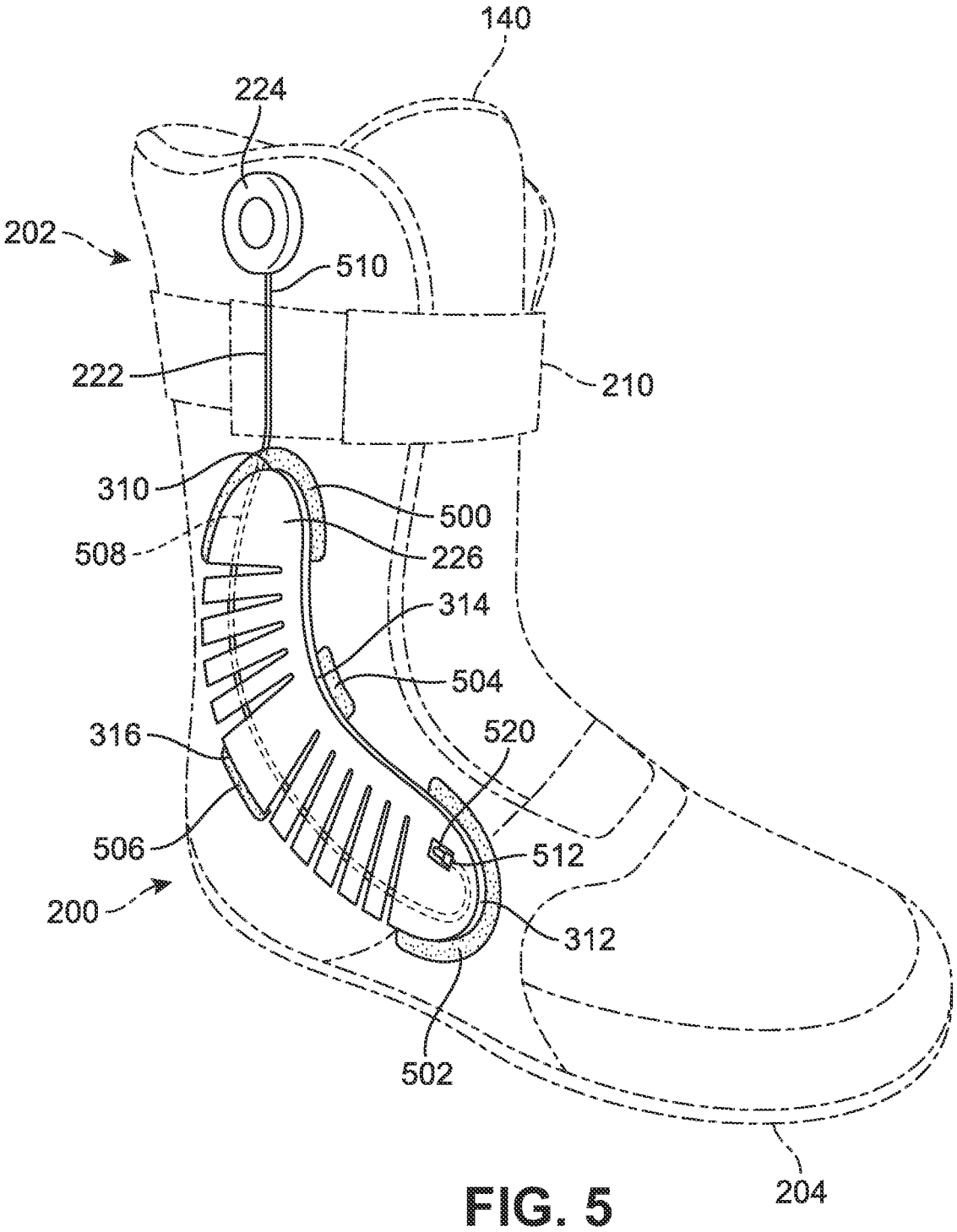
FIG. 5 is an isolated lateral isometric view of an exemplary embodiment of an inner liner for an article of footwear having an adjustable tensioning system with the inner liner in phantom.

Referring now to FIG. 5, an isolated lateral isometric view of lateral tensioning system 220 with inner liner 140 shown in phantom is illustrated. As described above, lateral tensioning system 220 on lateral side 16 of inner liner 140 includes a number of components disposed along inner liner 140, including tensioning cable 222, tension control device 224, and comb body structure 226. In some embodiments, one or more portions of lateral tensioning system 220 may be disposed under or between layers of inner liner 140. In some embodiments, comb body structure 226 may include one or more provisions that are configured assist with mounting comb body structure 226 along inner liner 140. In an exemplary embodiment, comb body structure 226 may include a plurality of flanges disposed at various locations around the outer perimeter. The plurality of flanges may be a flattened portion of comb body structure 226 having an overall thinner cross-section that extends outward from the outer perimeter of comb body structure 226 to facilitate attaching or securing comb body structure 226 to inner liner 140.

In an exemplary embodiment, comb body structure 226 may include an upper flange 500 that is disposed adjacent to proximal end 310. Upper flange 500 may be disposed under or between layers of upper liner portion 202 of inner liner 140. Similarly, comb body structure 226 may include a lower flange 502 that is disposed adjacent to distal end 312. Lower flange 502 may be disposed under or between layers of lower liner portion 200 of inner liner 140. Together, upper flange 500 and lower flange 502 may be configured to attach or secure the opposite ends of comb body structure 226 to inner liner 140 with the desired alignment and placement on the exterior of inner liner 140. In some embodiments, comb body structure 226 may further include one or more flanges disposed along the sides, including a leading flange 504 disposed approximately in the middle of leading side 314 and a trailing flange 506 disposed approximately in the middle of trailing side 316. Each of leading flange 504 and trailing flange 506 may be disposed under or between layers of inner liner 140, including a portion of upper liner portion 202 and/or a portion of lower liner portion 200. With this arrangement, leading flange 314 and/or trailing flange 316 may be configured to further attach or secure comb body structure 226 to inner liner 140.

In this embodiment, four flanges disposed along the outer perimeter of comb body structure 226 are shown. In other embodiments, however, a smaller or larger number of flanges may be used to assist with attaching or securing comb body structure 226 to inner liner 140. In still other embodiments, comb body structure 226 may include a substantially continuous flange that extends around the majority of the outer perimeter of comb body structure 226. In addition, the flanges may be used to attach comb body structure 226 to inner liner 140 using any attachment mechanism, including, but not limited to bonding using welding or adhesives, sewing, bolting or riveting, or other known mechanisms to securely attach comb body structure 226 to one or more layers of inner liner 140.

In some embodiments, one or more portions of a tensioning element, including tensioning cable 222, may be disposed through or between layers of inner liner 140 and/or portions of a body structure. In an exemplary embodiment, a first end portion 510 of tensioning cable 222 is attached to tension control device 224 in upper liner portion 202. Tensioning cable 222 extends from tension control device 224 downwards towards proximal end 310 of comb body structure 226. In an exemplary embodiment, tensioning cable 222 may extend under or between one or more layers of inner liner 140. In some embodiments, tensioning cable 222 may be disposed through a portion of comb body structure 226 via an interior channel 508. Interior channel 508 may be configured to extend along the longitudinal direction of comb body structure 226 from proximal end 310 to an anchor 520 disposed adjacent to distal end 312.

In an exemplary embodiment, tensioning cable 222 may be attached to anchor 520 at a second portion 512. In one embodiment, anchor 520 may be a nut or crimped cap on second end portion 512 of tensioning cable 222 that is configured to secure or fixedly attach second end portion 512 of tensioning cable 222 to comb body structure 226. In this embodiment, anchor 520 may secure tensioning cable 222 at a location adjacent to distal end 312 of comb body structure 226. In other embodiments, however, anchor 520 may be configured to secure or fixedly attach second end portion 512 of tensioning cable 222 at other locations within comb body structure 226.

Figure 6:
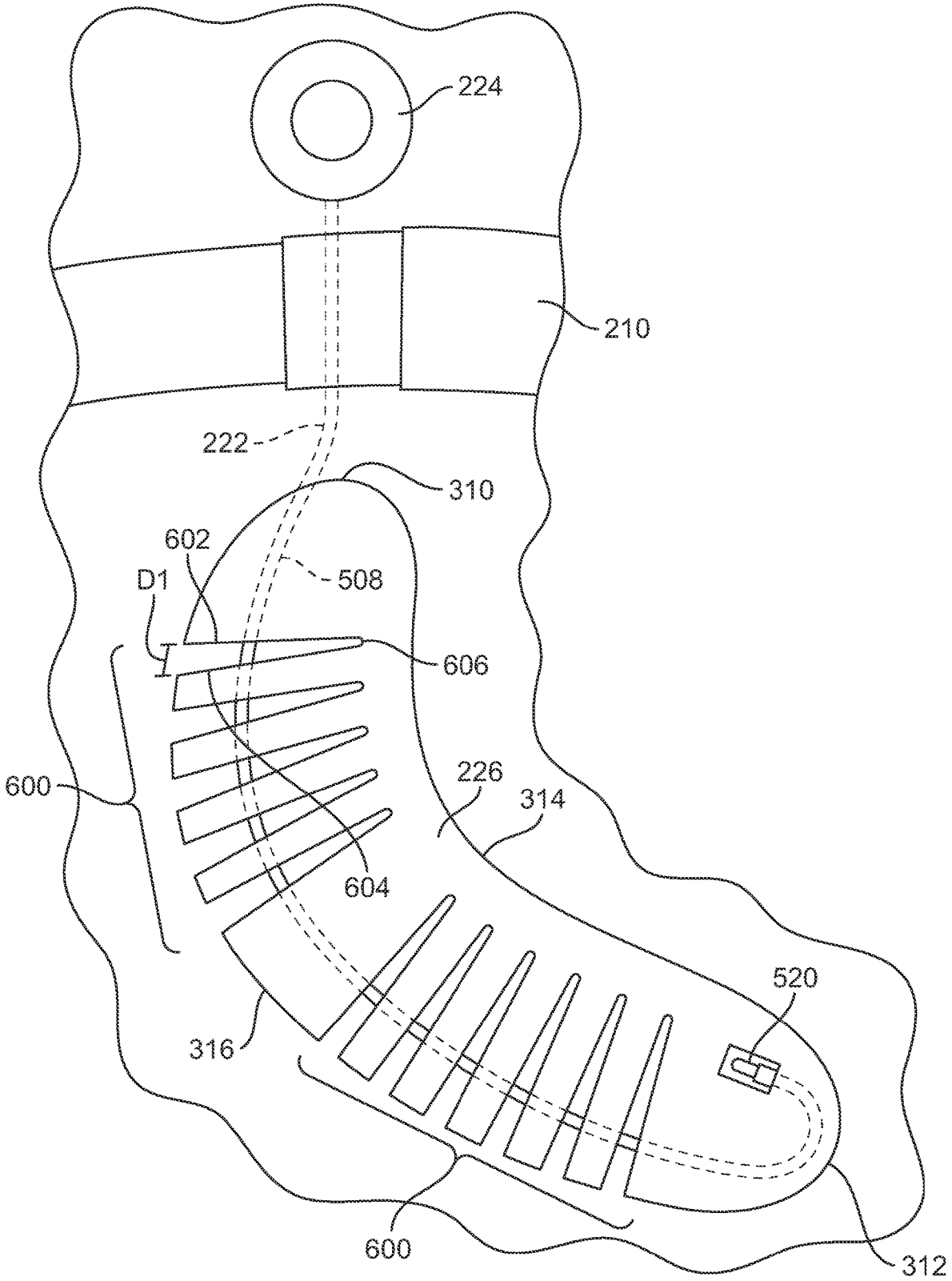
FIG. 6 is an enlarged representational view of an exemplary embodiment of an adjustable tensioning system on an inner liner in an open configuration.
Figure 7:
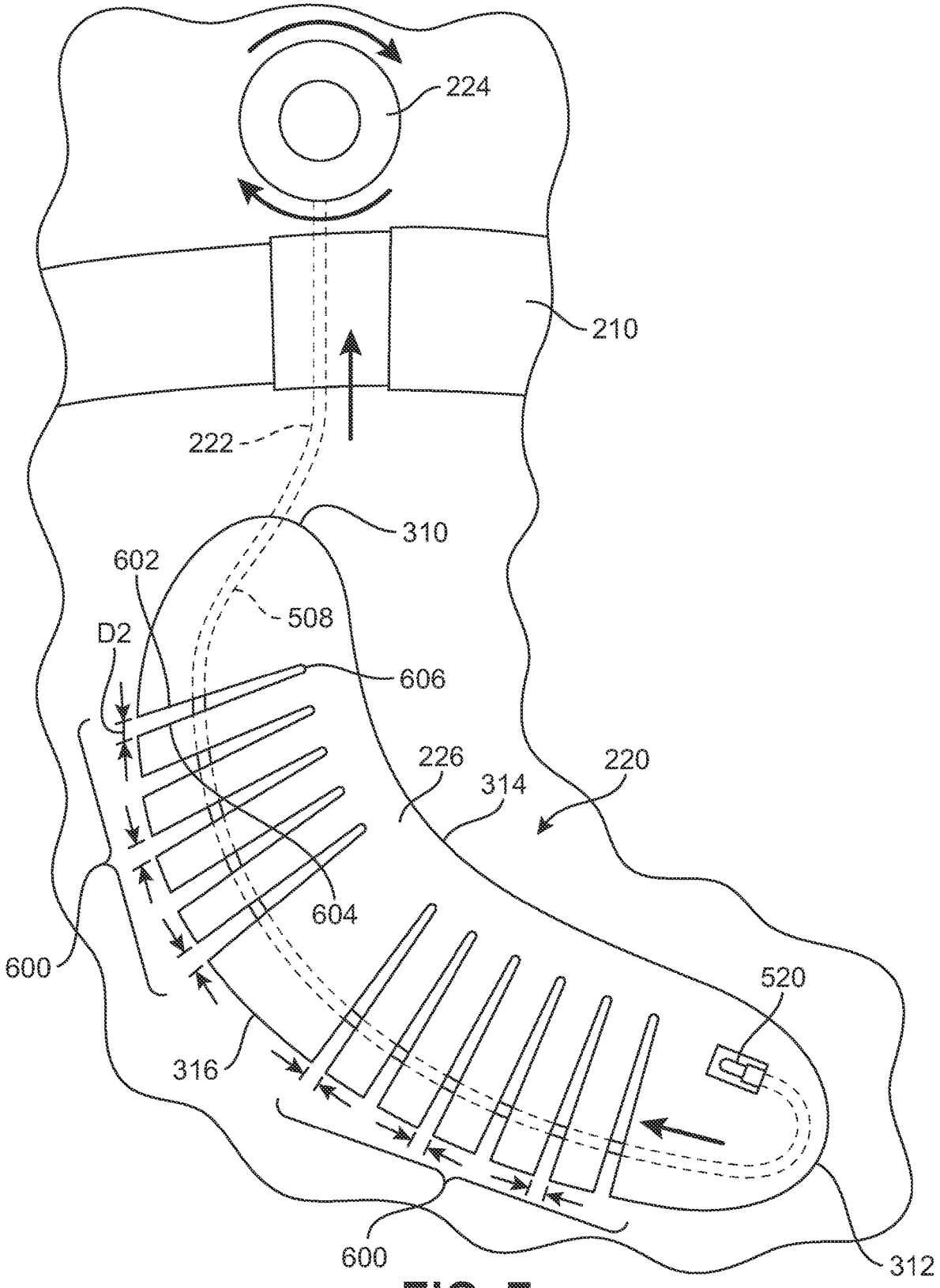
FIG. 7 is an enlarged representational view of an exemplary embodiment of an adjustable tensioning system on an inner liner being tightened.
Figure 8:
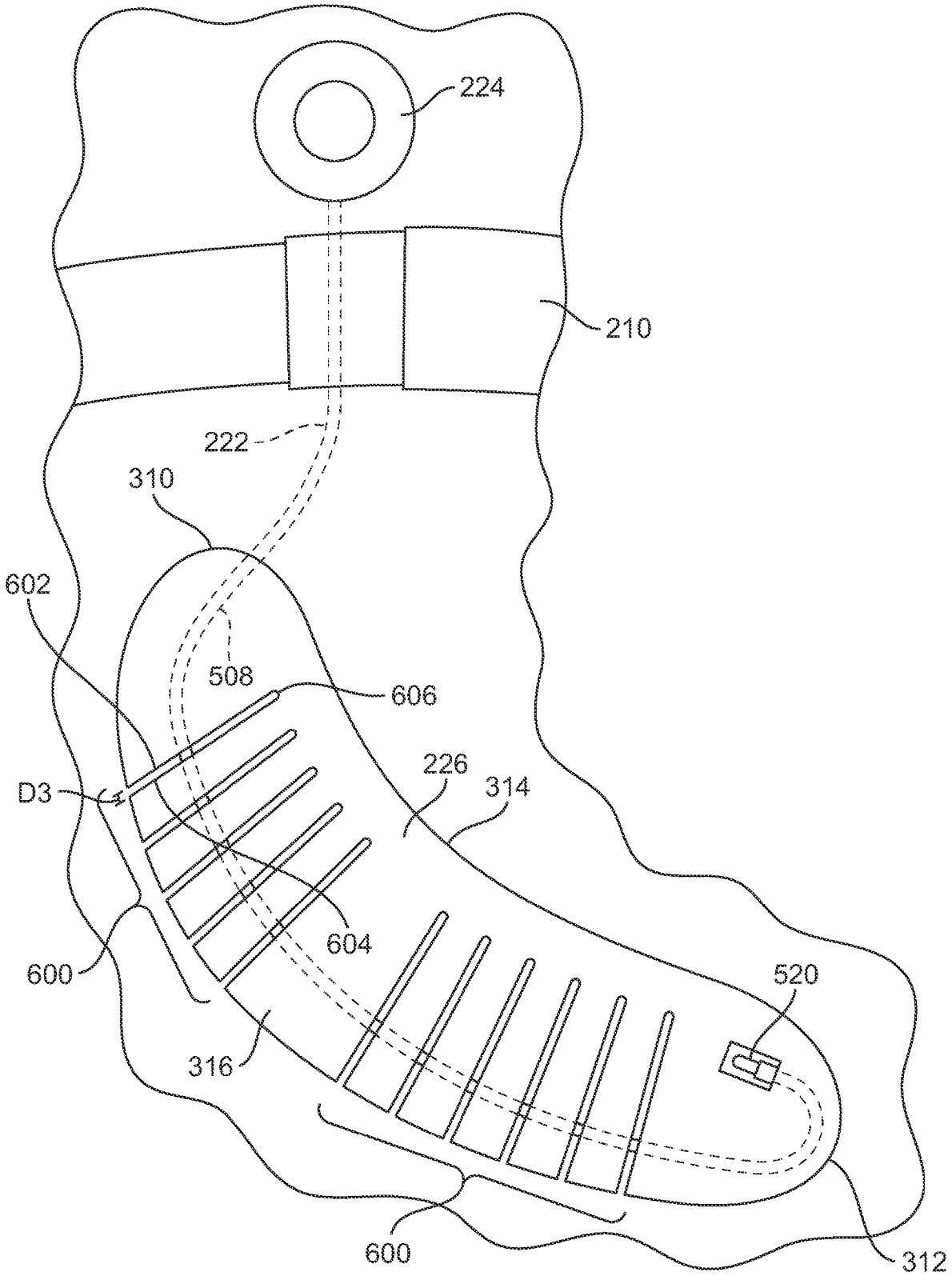
FIG. 8 is an enlarged representational view of an exemplary embodiment of an adjustable tensioning system on an inner liner in a closed configuration.
Figure 9:
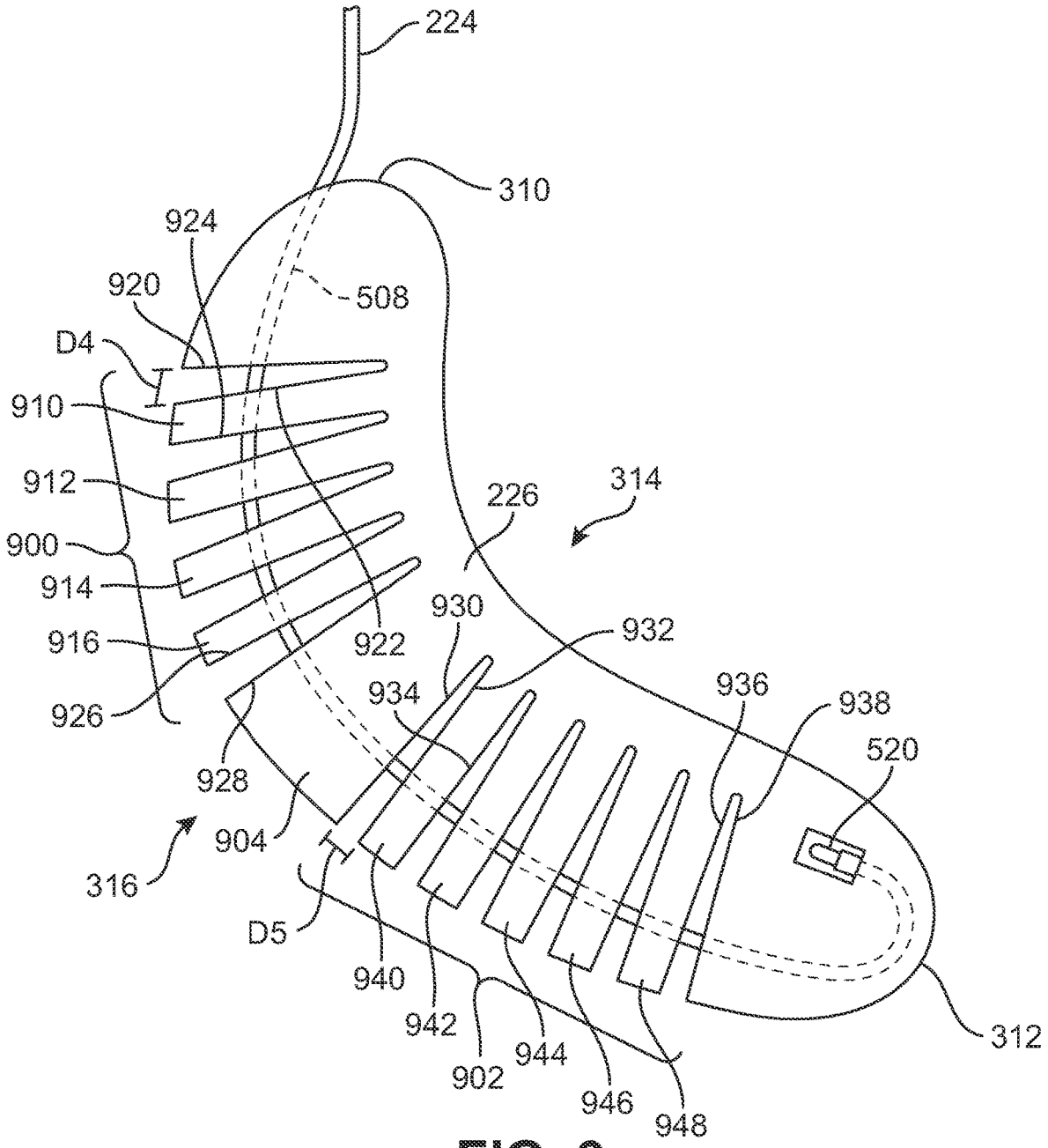
FIG. 9 is a plan view of an exemplary embodiment of a comb body structure in an open configuration.
Figure 10:
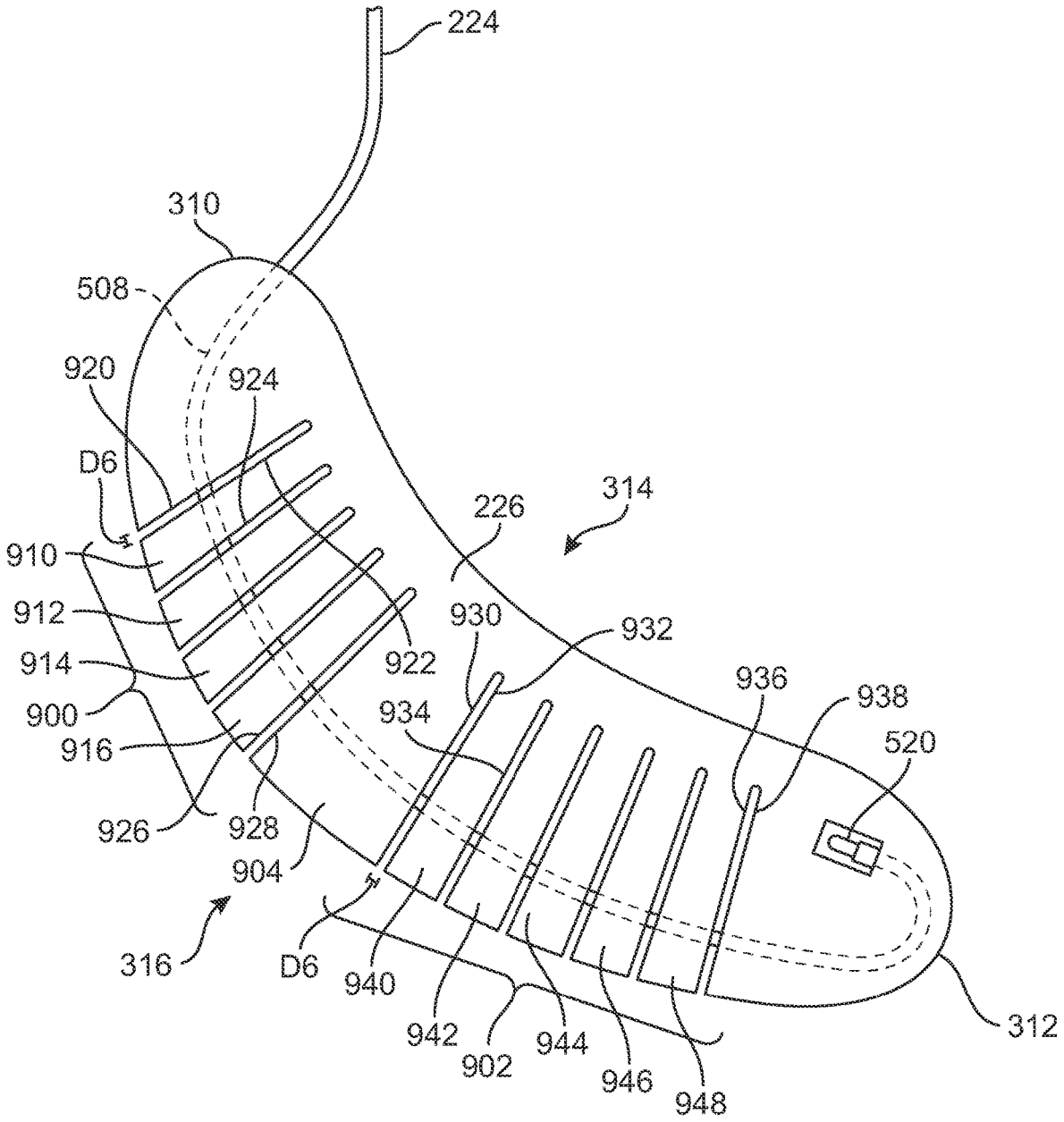
FIG. 10 is a plan view of an exemplary embodiment of a comb body structure in a closed configuration.

In some embodiments, interior channel 508 containing tensioning cable 222 may be configured to extend through a plurality of extending finger members that are spaced apart from each other and that are integrally formed with comb body structure 226. FIGS. 6 through 10 illustrate various views of a body structure including a plurality of extending finger members that may be configured to move closer towards each other upon application of tension from tensioning cable 222. In particular, FIGS. 6 through 8 illustrate comb body structure 226 moving between an open configuration and a fully closed configuration upon the application of increasing amounts of tension from tensioning cable 222. FIGS. 9 and 10 illustrate detailed plan views of comb body structure 226 corresponding to the open configuration and the fully closed configuration, respectively.

Referring now to FIG. 6, an enlarged representational view of lateral tensioning system 220 disposed on lateral side 16 of inner liner 140 is illustrated in an open configuration. In some embodiments, comb body structure 226 may be configured to move between the open configuration and a fully closed configuration (as shown in FIGS. 8 and 10) by the application of increased tension to tensioning cable 222 using tension control device 224. In some embodiments, a body structure may include provisions that are configured to allow portions of the body structure to undergo flexing. In an exemplary embodiment, comb body structure 226 may include a plurality of extending finger members 600 that are spaced apart from each other and that are integrally formed with comb body structure 226.

In an exemplary embodiment, plurality of extending finger members 600 may be disposed along trailing side 316 of comb body structure 226. As described above, in one embodiment, interior channel 508 may be disposed through comb body structure 226 including through one or more finger members associated with plurality of extending finger members 600. Tensioning cable 222 may extend through interior channel 508 from proximal end 310 of comb body structure 226 to anchor 520 disposed adjacent to distal end 312 of comb body structure 226. In this embodiment, tensioning cable 222 passes through portions of plurality of extending finger members 600.

In some embodiments, plurality of extending finger members 600 may be configured to allow portions of comb body structure 226 to undergo flexing. In an exemplary embodiment, plurality of extending finger members 600 may be initially spaced apart from each other when no tension or a negligible amount of tension is applied by tensioning cable 222 to comb body structure 226. As shown in this embodiment, representative adjacent finger members of plurality of extending finger members 600 may be spaced apart by a first distance D1 between a first edge 602 and a second edge 604. In addition, as noted above plurality of extending finger members 600 may be integrally joined with the remaining portion of comb body structure 226 at a vertex portion 606.

Figure 26:
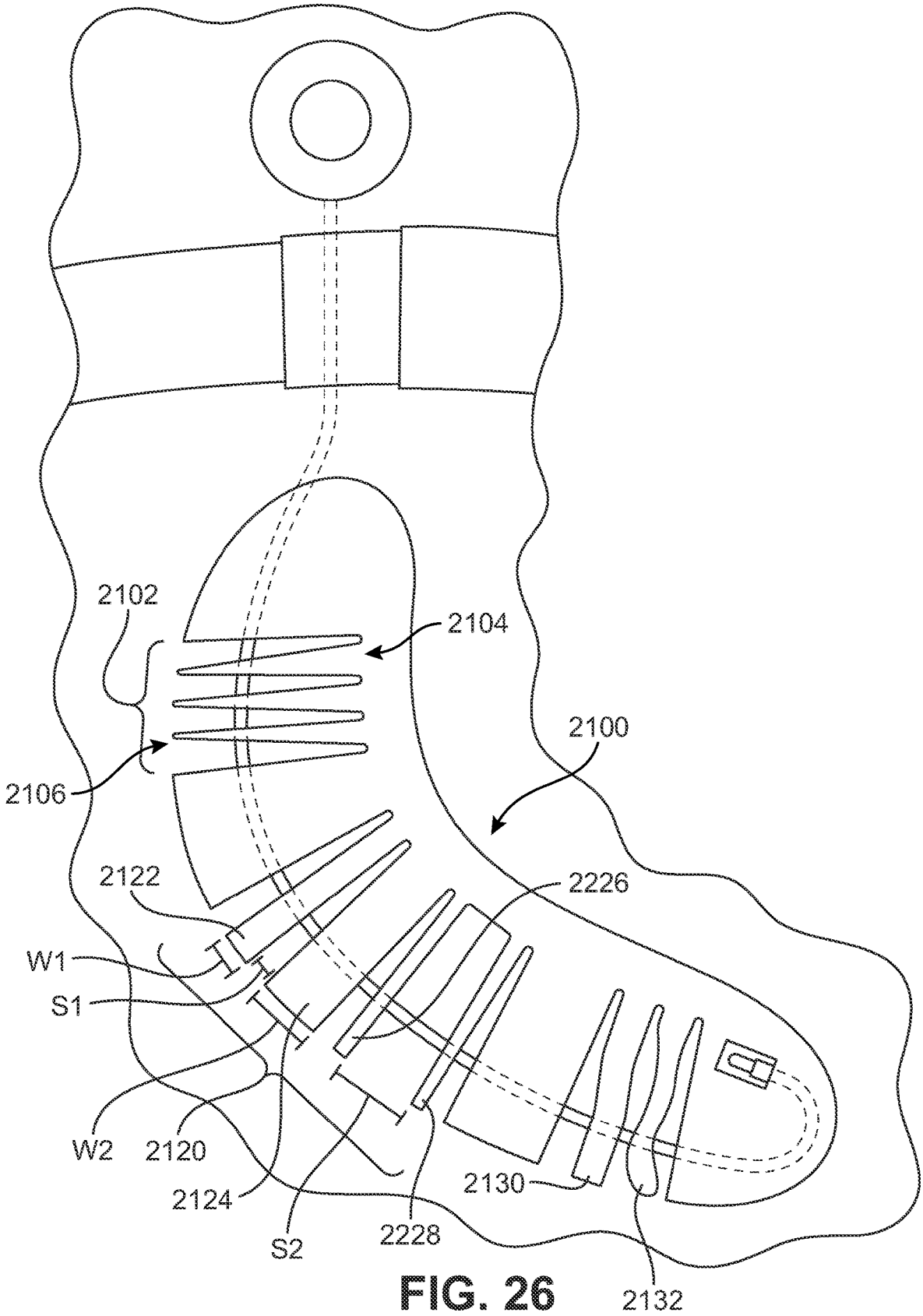
FIG. 26 is a schematic view of another embodiment of a body structure incorporating a variety of finger members of differing shapes.
Figure 27:
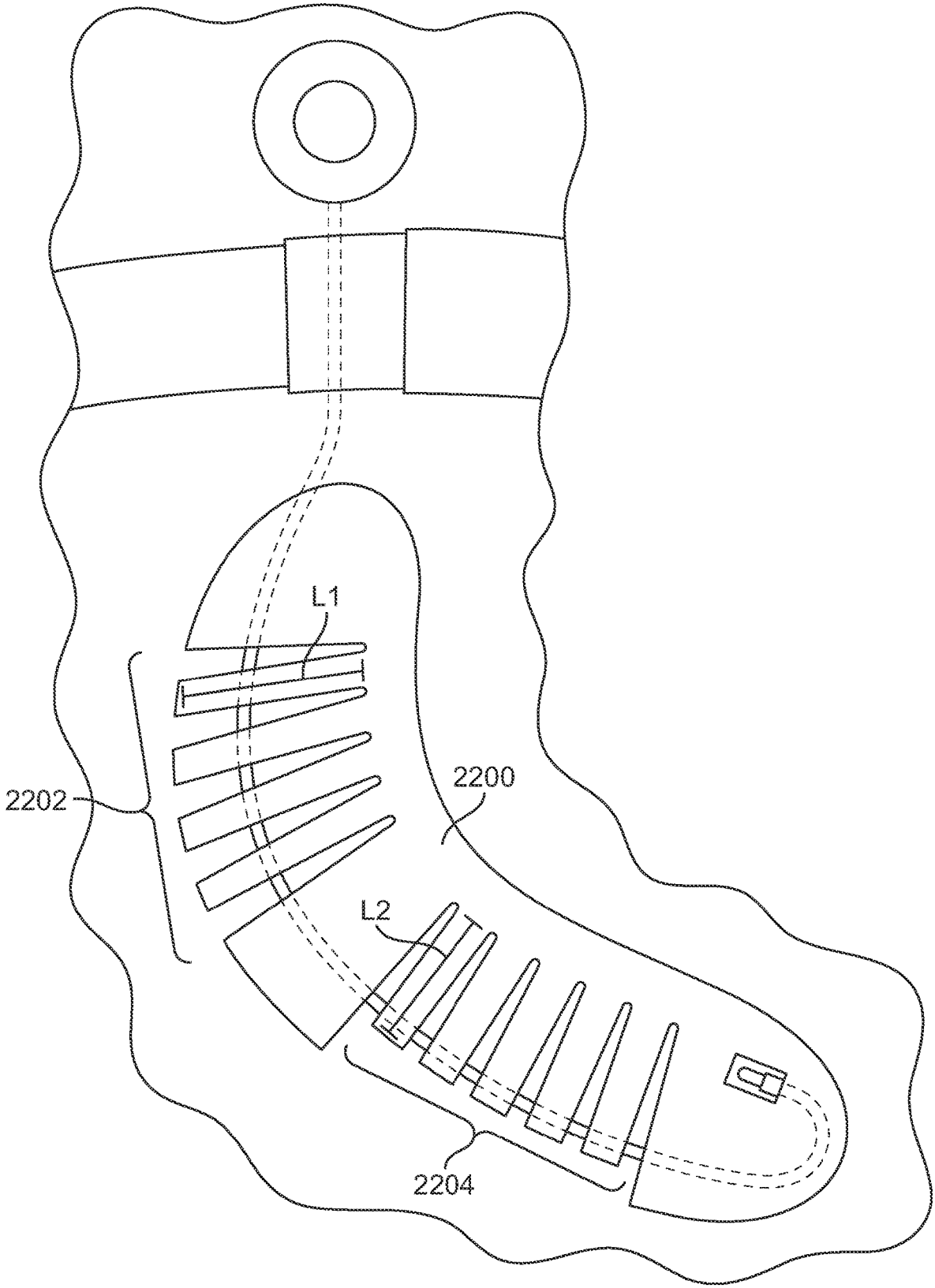
FIG. 27 is a schematic view of another embodiment of a body structure incorporating finger members of different lengths.

In different embodiments, the sizes, shapes and/or spacing of one or more finger members could vary. FIG. 26 illustrates a schematic view of an embodiment of a comb body structure 2100 that incorporates finger members having a variety of different geometries and relative spacing. For example, a first group of finger members 2102 comprise finger members with widths that decrease substantially from base portions 2104 to tip portions 2106. Such a narrowing configuration for one or more finger members may provide for increased flexibility along portions of comb body structure 2100. A second group of finger members 2120 comprises finger members of varying widths, which are further separated by varying amounts. For example, a first finger member 2122 has a width W1 while a second finger member 2124 has a width W2, where width W2 may be substantially greater than width W1. Furthermore, first finger member 2122 and second finger member 2124 may be separated by spacing S1, while a third finger member 2126 and a fourth finger member 2128 may be separated by a spacing S2 that is substantially greater than spacing S1. Varying the widths and/or relative spacing between various finger members may allow a manufacturer to tune the tensioning properties of comb body structure 2100. Additionally, as seen in FIG. 26, some embodiments could incorporate one or more irregularly shaped finger members, such as first irregularly shaped finger member 2130 and second irregularly shaped finger member 2132. Again, the geometry of various irregularly shaped finger members may be selected to tune the tensioning properties of comb body structure 2100. Referring next to FIG. 27, in still another embodiment, the lengths of one or more finger members could vary. For example, as seen in FIG. 27, a first group of finger members 2202 may hay an approximate length L1, while a second group of finger members 2204 may have an approximate length L2 that may be substantially less than length L1. Varying the lengths of finger members allows for variations in finger rigidity, which may affect tensioning characteristics of comb body structure 2200.

As shown in FIG. 6, in an open configuration corresponding to no tension or a negligible amount of tension, adjacent edges of plurality of extending finger members 600, for example, first edge 602 and second edge 604, may separate from vertex portion 606 to first distance D1 along trailing edge 314 of comb body structure 226. Each individual finger member may have a substantially similar configuration and may be spaced apart by first distance D1 or other distances that are smaller or larger. With this open configuration, comb body structure 226, and therefore, inner liner 140 and/or article 100, may be allowed to undergo a certain degree or amount of flexing when article 100 is worn.

Figure 28:
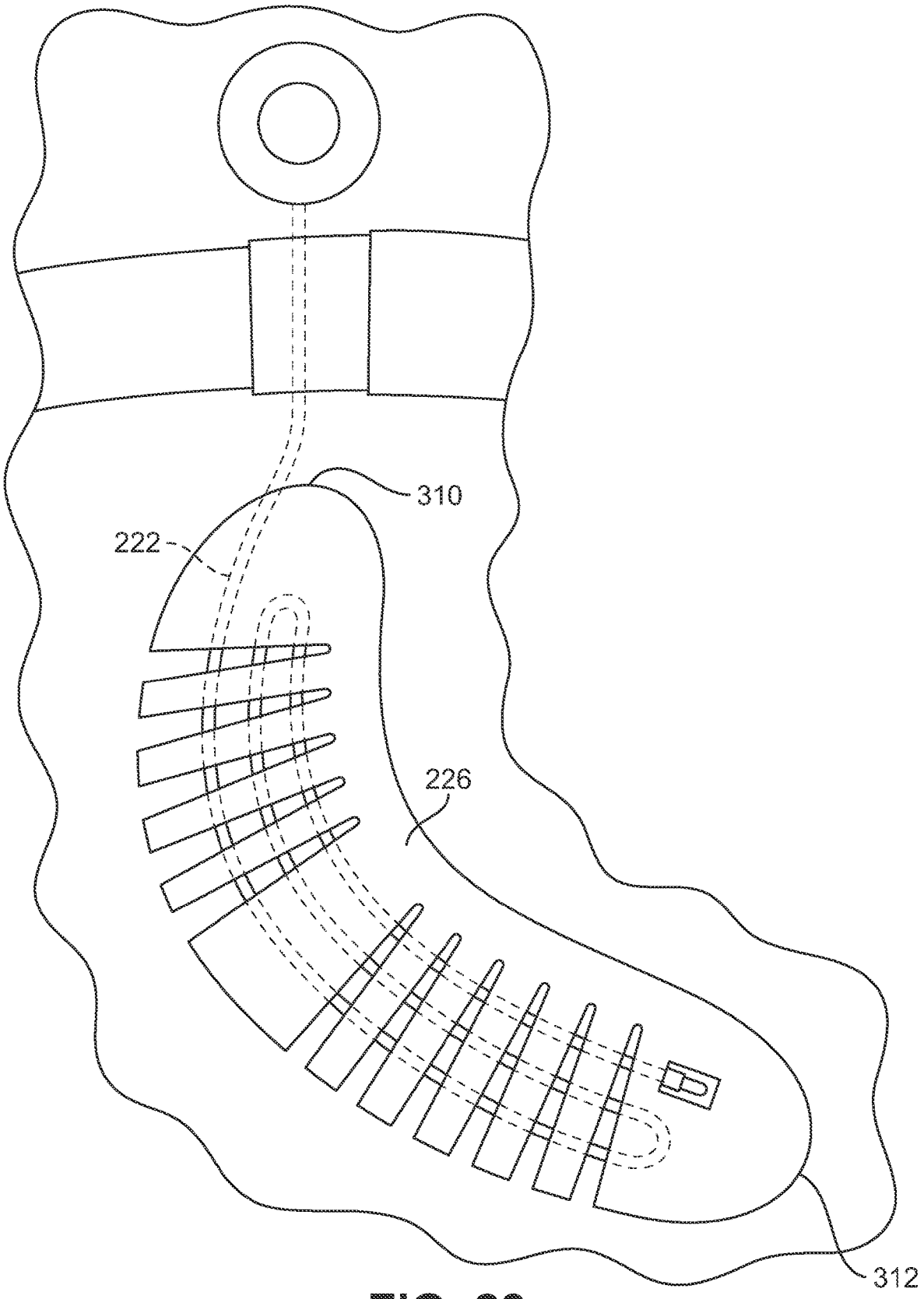
FIG. 28 is a schematic view of another embodiment of a tensioning system with an alternative configuration for the tensioning cable.

The particular arrangement of tensioning cable 222 along comb body structure 226 is only intended to be exemplary. In other embodiments, tensioning cable 222 could have a different path along comb body structure 226. For example, FIG. 28 illustrates an alternative configuration for tensioning cable 222, in which tensioning cable 222 winds from proximal end 310 to distal end 312, up towards proximal end 310 and back down to distal end 312, before being anchored at distal end 312. By varying the arrangement of tensioning cable 222 on comb body structure 226, the tensioning characteristics of comb body structure 226 can be further tuned.

Referring now to FIG. 7, an enlarged representational view of lateral tensioning system 220 disposed on lateral side 16 of inner liner 140 is illustrated undergoing tightening. In this embodiment, tension control device 224 is rotated to tighten tensioning cable 222 within interior channel 508 disposed through plurality of extending finger members 600. As tensioning cable 222 is tightened the tension applies a force to tensioning cable 222 against anchor 520 disposed adjacent to distal end 312. The force associated with the tightening of lateral tensioning system 220 causes tensioning cable 222 to bring each individual finger member of plurality of extending finger members 600 closer to each other so as to reduce the separation distance between adjacent edges. For example, in this embodiment, the applied amount of tension causes first edge 602 and second edge 604 to move closer together along trailing edge 314 of comb body structure 226 so as to be separated by a second distance D2 that is smaller than first distance D1.

Referring now to FIG. 8, an enlarged representational view of lateral tensioning system 220 disposed on lateral side 16 of inner liner 140 is illustrated in a fully closed configuration. In this embodiment, tension control device 224 has been rotated to tighten tensioning cable 222 by an amount of tension that corresponds to a high degree or amount of tension applied to comb body structure 226 so as to bring each individual finger member of plurality of extending finger members 600 together in a fully closed configuration. In some cases, plurality of extending finger members 600 may be substantially abutting along adjacent edges in a fully closed configuration. In other cases, plurality of extending finger members 600 may be separated by a small distance corresponding to the width of a vertex portion adjoining adjacent finger members.

For example, in the present embodiment, in a fully closed configuration, the fully applied amount of tension causes first edge 602 and second edge 604 to move together along trailing edge 314 of comb body structure 226 so as to be separated by a third distance D3 that is smaller than first distance D1 and second distance D2. In some cases, third distance D3 may be substantially smaller than second distance D2 and first distance D1. In other cases, third distance D3 may be negligible and be approximately zero. With this arrangement, the fully closed configuration of comb body structure 226 is under tension provided by tensioning cable 222 and tension control device 224 so as to prevent or limit a significant degree or amount of flexing when article 100 is worn. Thus, the fully closed configuration corresponds to a stiffer, less flexible arrangement for an article 100 than the open configuration, described above.

Figure 29:
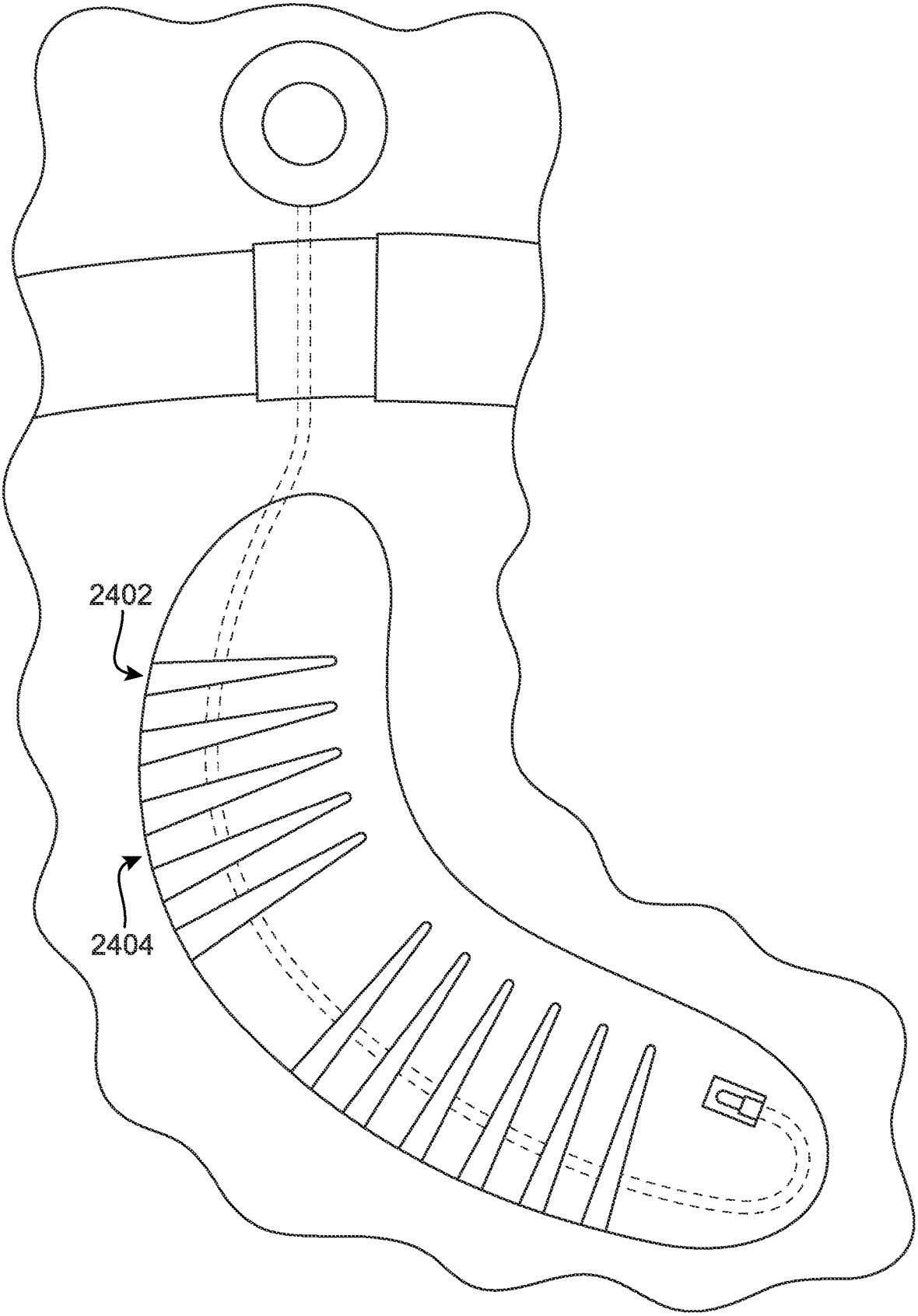
FIG. 29 is a schematic view of another embodiment of a body structure including a filler material in the region between adjacent finger members.

Although some embodiments illustrate finger members that are separated by open regions, i.e. regions of no material, other embodiments can incorporate provisions that fill in these open regions. For example, an alternative embodiment shown in FIG. 29 includes a plurality of filling members 2402 that fill in the spaces between adjacent finger members 2404. In some embodiments, filling members 2402 could comprise a foam-like material. However, in other embodiments any other kinds of materials could be used. In some embodiments, the materials used for plurality of filling members 2402 may be selected to achieve a desired flexibility or elasticity for the regions between adjacent finger members.

In some embodiments, a body structure may include one or more portions having different flexing properties. FIGS. 9 and 10 illustrate plan views of an exemplary embodiment of comb body structure 226 in an open and fully closed configuration, respectively. In an exemplary embodiment, comb body structure 226 may include multiple portions associated with varying flexing properties. In this embodiment, comb body structure 226 may include a first flex portion 900 and a second flex portion 902. In an exemplary embodiment, first flex portion 900 may be a portion of comb body structure 226 associated with a first set of extending finger members. In this embodiment, each of the finger members of the first set of extending finger members may be substantially similar. Together, the first set of extending finger members provides comb body structure 226 with a first degree or amount of flexibility at first flex portion 900.

In an exemplary embodiment, second flex portion 902 may be a portion of comb body structure 226 associated with a second set of extending finger members. In this embodiment, each of the finger members of the second set of extending finger members may be substantially similar. Together, the second set of extending finger members provides comb body structure 226 with a second degree or amount of flexibility at second flex portion 902. In some cases, the first amount of flexibility provided by first flex portion 900 may be different from the second amount of flexibility provided by second flex portion 902.

Figure 30:
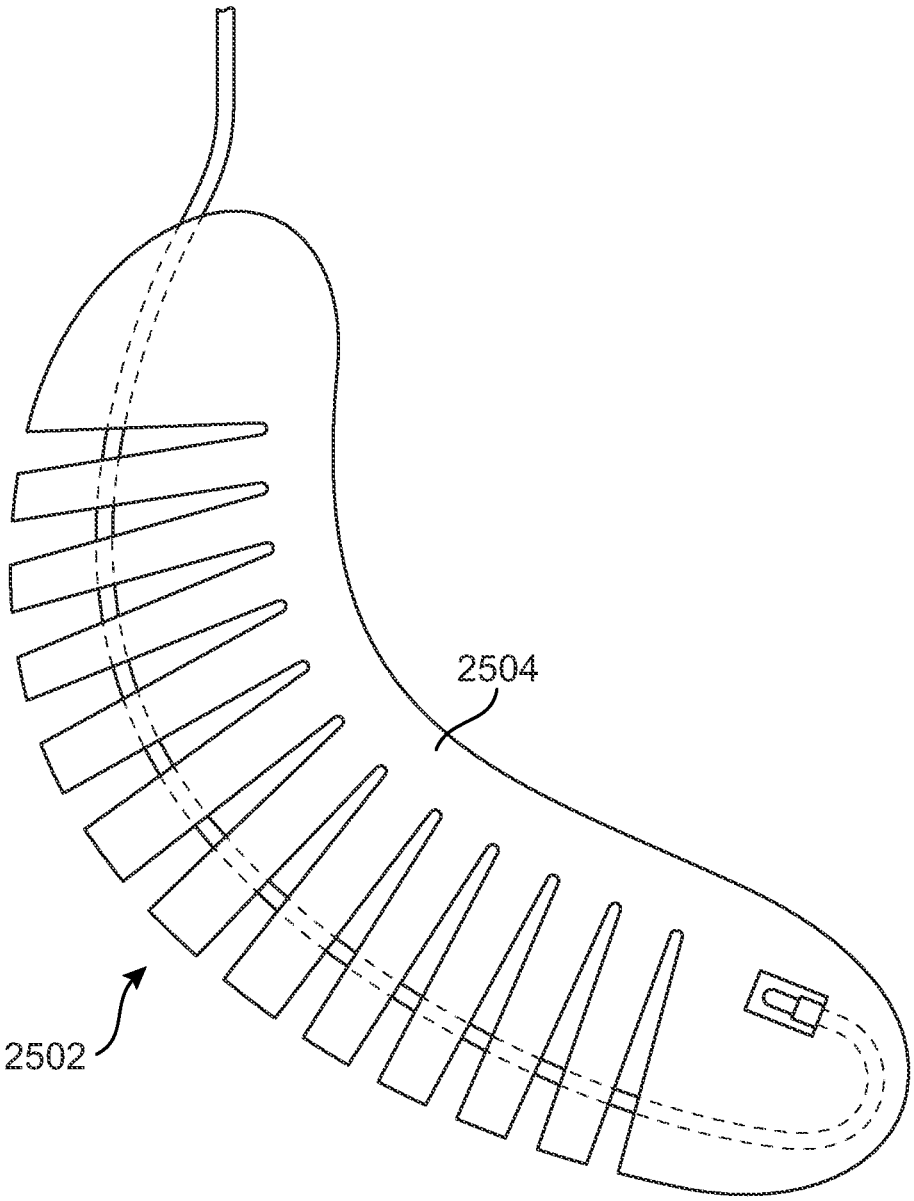
FIG. 30 is a schematic view of another embodiment of a body structure, in which the finger members are substantially evenly spaced.

In some embodiments, first flex portion 900 and second flex portion 902 may be spaced apart by an intermediate portion 904. In an exemplary embodiment, intermediate portion 904 may not include any finger members. As a result, comb body structure 226 may not significantly flex at intermediate portion 904. In other embodiments, however, finger members may be evenly spaced along the entire length of a comb body structure and may not be separated into distinct flexing regions. Such a configuration is shown, for example, in FIG. 30, in which plurality of finger members 2502 extend continuously along the length of comb body structure 2504. In particular, plurality of finger members 2502 may comprise a single flex portion that spans a majority of the length of comb body structure 2504.

In one embodiment, first flex portion 900 may be associated with the first set of extending finger members that includes a first finger member 910, a second finger member 912, a third finger member 914, and a fourth finger member 916. As shown in FIG. 9, in an open configuration, first finger member 910 may have a first upper edge 922 that is spaced apart from a proximal bottom edge 920 by a first separation distance D4. In addition, a first lower edge 924 of first finger member 910 may be spaced apart from an adjacent edge of second finger member 912 by first separation distance D4. A similar configuration may be applied to the remaining finger members, including second finger member 912, third finger member 914, and/or fourth finger member 916. As shown in FIG. 9, a second lower edge 926 of fourth finger member 916 is spaced apart from an upper intermediate edge 928 of intermediate portion 904 by first separation distance D4. With this arrangement, each of the finger members of the first set of extending finger members associated with first flex portion 900 may substantially uniformly spaced apart by first separation distance D4 in the open configuration.

In one embodiment, second flex portion 902 may be associated with the second set of extending finger members that includes a fifth finger member 940, a sixth finger member 942, a seventh finger member 944, an eighth finger member 946, and a ninth finger member 948. As shown in FIG. 9, fifth finger member 940 may have a second upper edge 932 that is spaced apart from a lower intermediate edge 930 of intermediate portion 904 by a second separation distance D5. A third lower edge 934 of fifth finger member 940 may be spaced apart from an adjacent edge of sixth finger member 942 by second separation distance D5. A similar configuration may be applied to the remaining finger members, including sixth finger member 942, seventh finger member 944, eighth finger member 946, and/or ninth finger member 948. As shown in FIG. 9, ninth finger member 948 may have a fourth lower edge 936 that is spaced apart from a distal top edge 938 of comb body structure 226 by second separation distance D5. With this arrangement, each of the finger members of the second set of extending finger members associated with second flex portion 902 may substantially uniformly spaced apart by second separation distance D5 in the open configuration.

In one embodiment, second separation distance D5 may be smaller than first separation distance D4. With this arrangement, first flex portion 900 and second flex portion 902 may be configured to provide different degrees or amounts of flexing to the corresponding portions of comb body structure 226, and, therefore, inner liner 140 and/or article 100.

As shown in FIG. 9, comb body structure 226 with first flex portion 900 and second flex portion 902 is shown in an open configuration, as described above and with regard to FIGS. 6 through 8. In this open configuration, the individual finger members of the first set of extending finger members are separated by first separation distance D4 and the individual finger members of the second set of extending finger members are separated by second separation distance D5. Upon the application of tension to tensioning cable 222 using tension control device 224, the finger members may be brought closer together to a fully closed configuration.

Referring now to FIG. 10, a fully closed configuration for each of first flex portion 900 and second flex portion 902 is shown. As shown in this embodiment, each of the individual finger members of the first set of extending finger members and the second set of extending finger members have been brought into a substantially closed configuration by the application of tension from tensioning cable 222. In some cases, the fully closed configuration may correspond to individual finger members that are substantially abutting along adjacent edges. In other cases, the fully closed configuration may correspond to individual finger members that are separated by a small distance corresponding to the width of a vertex portion adjoining adjacent finger members.

For example, in the present embodiment, in a fully closed configuration, the applied amount of tension on tensioning cable 222 causes first upper edge 922 of first finger member 910 to be spaced apart from proximal bottom edge 920 by a third separation distance D6. In addition, first lower edge 924 of first finger member 910 is spaced apart from an adjacent edge of second finger member 912 by third separation distance D6. Likewise, second upper edge 932 of fifth finger member 940 is spaced apart from lower intermediate edge 930 of intermediate portion 904 by third separation distance D6 and third lower edge 934 of fifth finger member 940 is also spaced apart from an adjacent edge of sixth finger member 942 by third separation distance D6. With this arrangement, each of the finger members of the first set of extending finger members associated with first flex portion 900 and/or the second set of extending finger members associated with second flex portion 902 may substantially minimally spaced apart by third separation distance D6 in the fully closed configuration.

In this embodiment, third separation distance D6 is substantially smaller than first separation distance D4 and/or second separation distance D5. In some embodiments, third separation distance D6 may be negligible and be approximately zero such that adjacent finger members will be abutting in the fully closed configuration. With this arrangement, the fully closed configuration of first flex portion 900 and/or second flex portion 902 of comb body structure 226 is under tension provided by tensioning cable 222 and tension control device 224 so as to prevent or limit a significant degree or amount of flexing when article 100 is worn.

In this embodiment, first flex portion 900 is shown associated with first set of extending finger members that includes four finger members and second flex portion 902 is shown associated with second set of extending finger members that includes five finger members. In other embodiments, however, each of first flex portion 900 and/or second flex portion 902 may be associated with sets of extending finger members that include a larger or smaller number of finger members.

Figure 11:
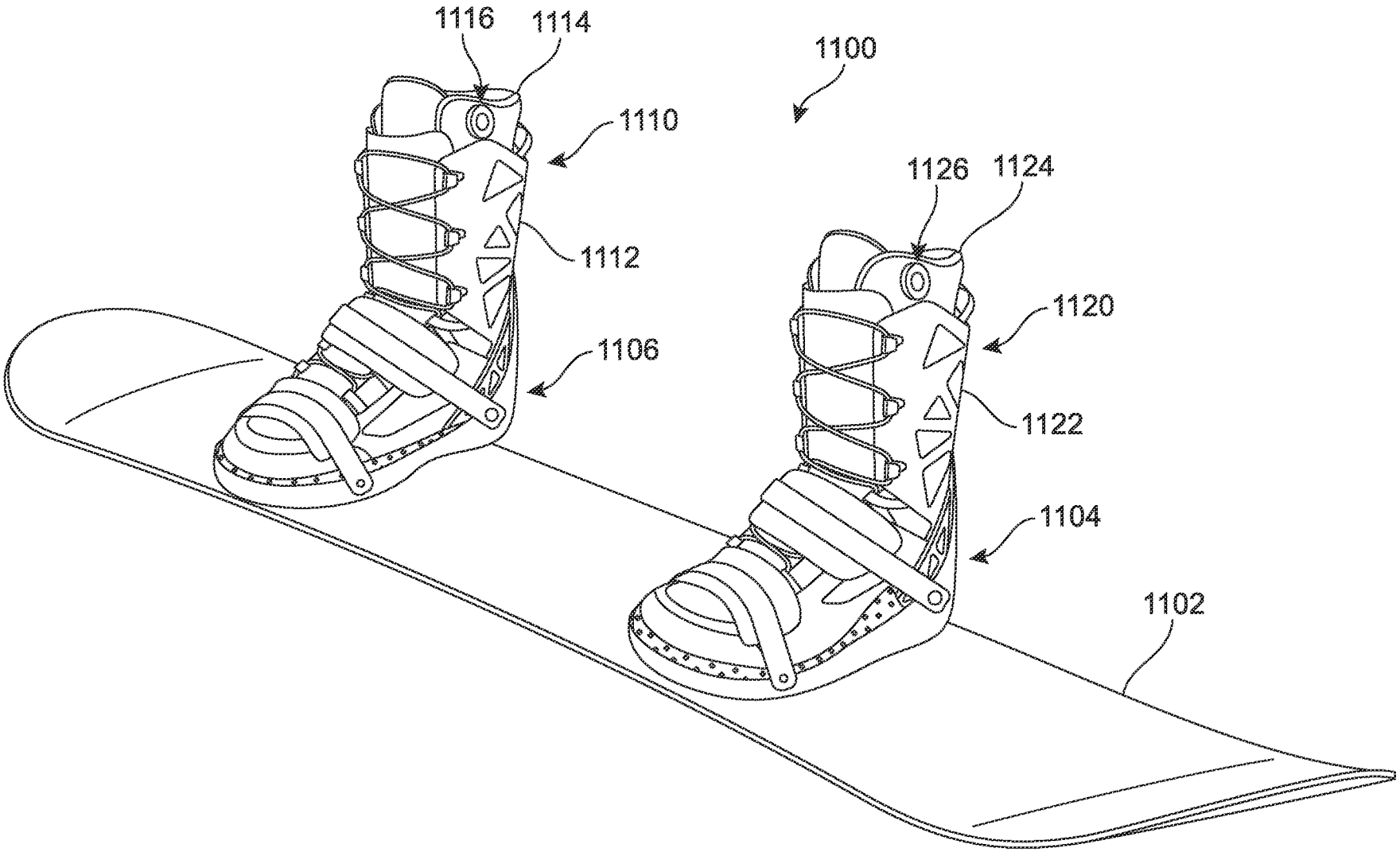
FIG. 11 is a schematic view of an exemplary embodiment of a pair of articles of footwear including adjustable tensioning systems associated with a snowboard.

FIG. 11 illustrates a pair of articles of footwear 1100 including adjustable tensioning systems being used with a snowboard. In some embodiments, a snowboard 1102 may be associated with pair of articles 1100 in the form of snowboard boots that includes a first article 1110 configured for a right foot and a second article 1120 configured for a left foot. In this embodiment, first article 1110 includes a first outer shell 1112 and a first inner liner 1114 with a first tension control device 1116 associated with an adjustable tensioning system. Similarly, second article 1120 includes a second outer shell 1122 and a second inner liner 1124 with a second tension control device 1126.

It should be understood that while only a single tension control device is visible in FIG. 11 for each of first article 1110 and second article 1120, adjustable tensioning systems may be disposed on each of the lateral and medial sides of the respective inner liner, as described above.

In some embodiments, pair of articles 1100 may be associated with snowboard 1102 using bindings, including a first binding 1104 and a second binding 1106. First binding 1104 and second binding 1106 may be any suitable conventional binding that is used to secure a boot to a snowboard or a ski. First binding 1104 and/or second binding 1106 may include fasteners along a base portion to secure each binding to snowboard 1102 and may further include additional components or mechanisms that are configured to secure pair of articles 1100 to binding 1000, including one or more straps.

Depending on the preferences of the wearer, for example, if the wearer has a regular left foot forward stance or a right foot forward "goofy foot" stance, a different boot may be placed at the front of snowboard 1102. As a result, the wearer may desire to adjust the stiffness of each boot, as well as the lateral and medial sides of each boot, individually to suit the wearer's stance on snowboard 1102.

Figure 12:
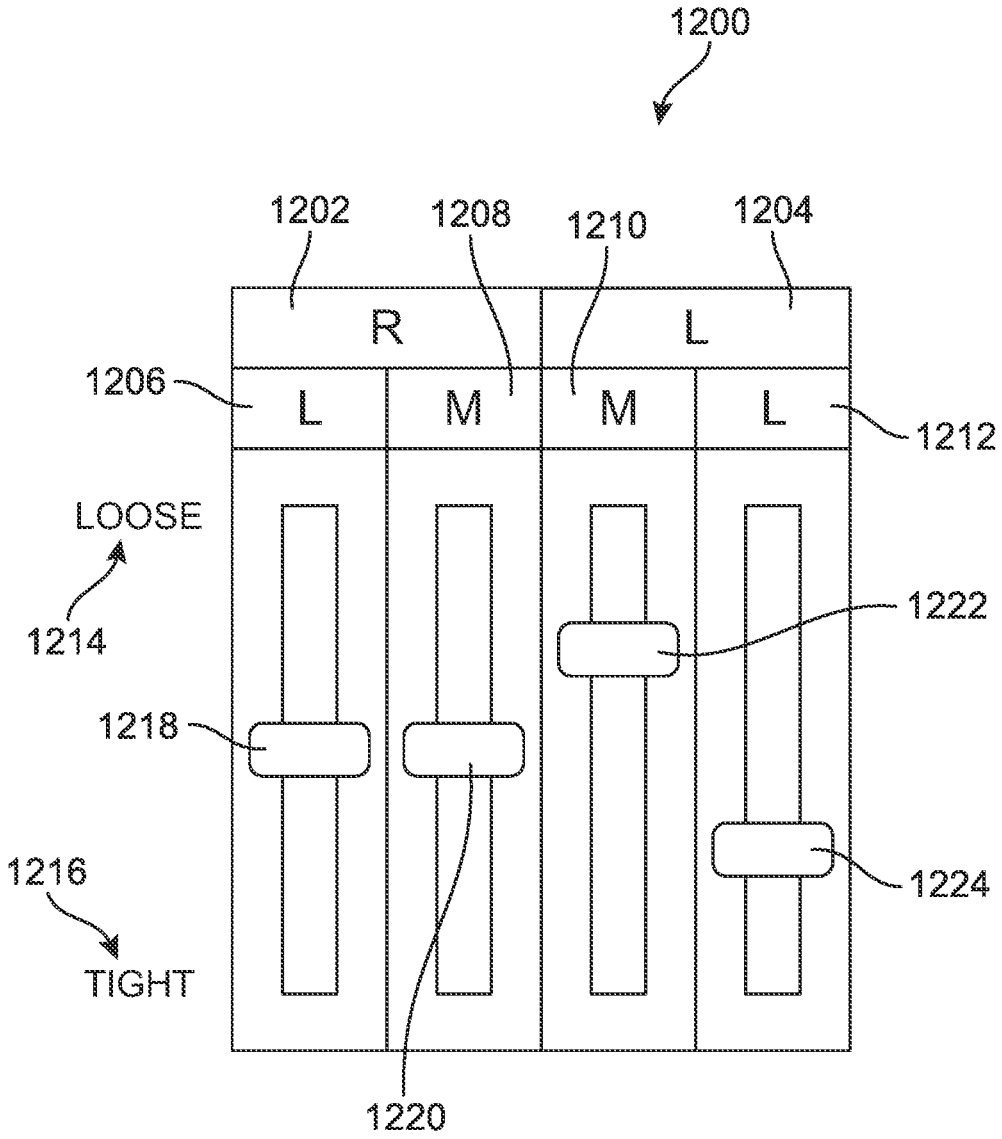
FIG. 12 is a representational chart of a range of flexibilities associated with a pair of articles of footwear including adjustable tensioning systems.

FIG. 12 illustrates a representational chart 1200 of the variations in adjustable stiffness that a wearer may select between a right boot 1202 and a left boot 1204, as well as between a lateral side 1206, 1212 and a medial side 1208, 1210 for each boot. Depending on the desired amount of stiffness, a wearer may adjust each side of each boot independently. Because the degree or amount of stiffness provided by the adjustable tensioning system may be regulated by a wearer by increasing or decreasing the tension applied to the tensioning cable using the tension control device, a wide variety or continuum of degrees or amounts of stiffness may be provided between a loose setting associated with an open or loosened configuration of a body structure and a tight setting associated with a fully closed or tightened configuration of a body structure.

Figure 13:
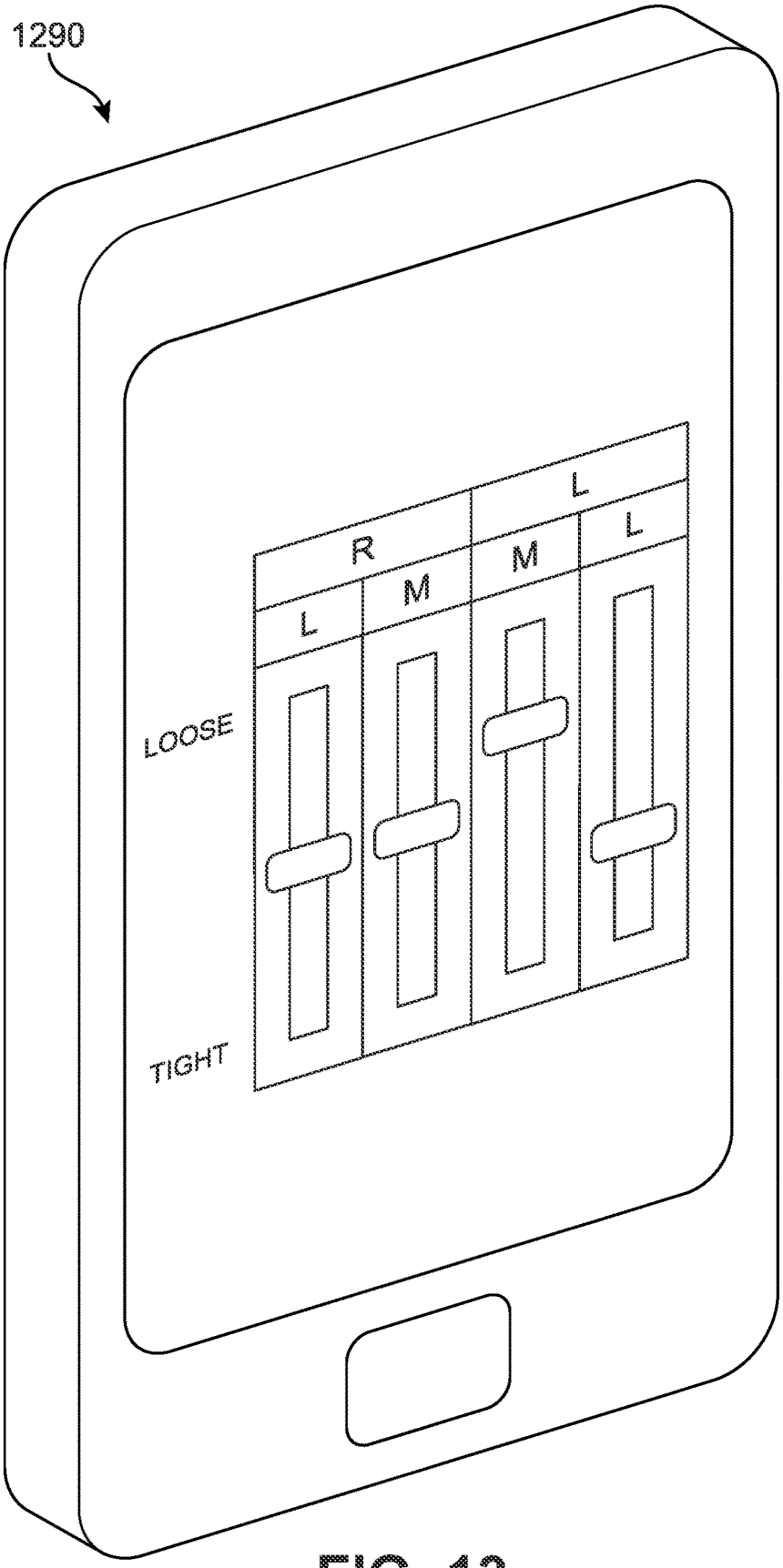
FIG. 13 is a schematic view of an embodiment of a hardware device used to display controls for a tensioning system.

For example, as shown in FIG. 12, a wearer may select a medium setting 1218 between loose 1214 and tight 1216 for both a medial side 1208 of a right boot 1202 and a similar medium setting 1220 for a lateral side 1206 of a right boot 1202. The wearer may desire a different level of stiffness for a left boot 1204, however, for example, where the left boot is the lead boot. In this embodiment, a wearer may select a generally looser or less stiff setting 1222 for a medial side 1210 of a left boot 1204, and may select a generally stiffer setting 1224 for a lateral side 1212 of a left boot 1204. With this arrangement, the lateral side of the left boot, in this case the lead boot (second article 1120 in FIG. 11), may have a significantly larger degree or amount of stiffness than the corresponding medial side of the same left boot, as well as both sides of the right boot, in this case the rear boot (first article 1110 in FIG. 11). In some embodiments, a user may control the stiffness settings using a software program running on a portable hardware device, such as a smartphone 1290 (see FIG. 13), personal digital assistant (PDA), tablet or other mobile computing device.

Figure 14:
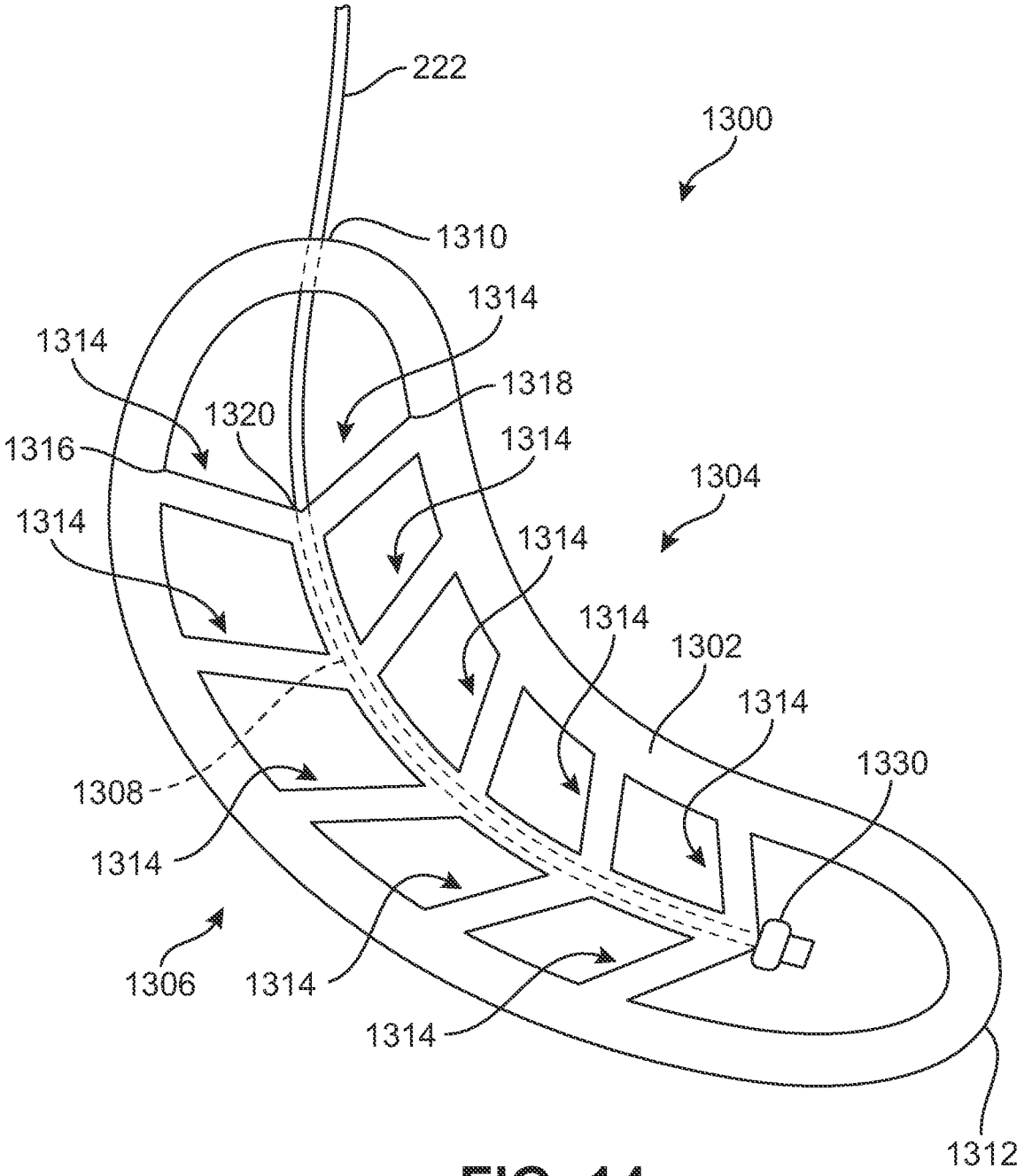
FIG. 14 is a schematic view of an alternate embodiment of a body structure for an adjustable tensioning system in an loosened configuration.
Figure 15:
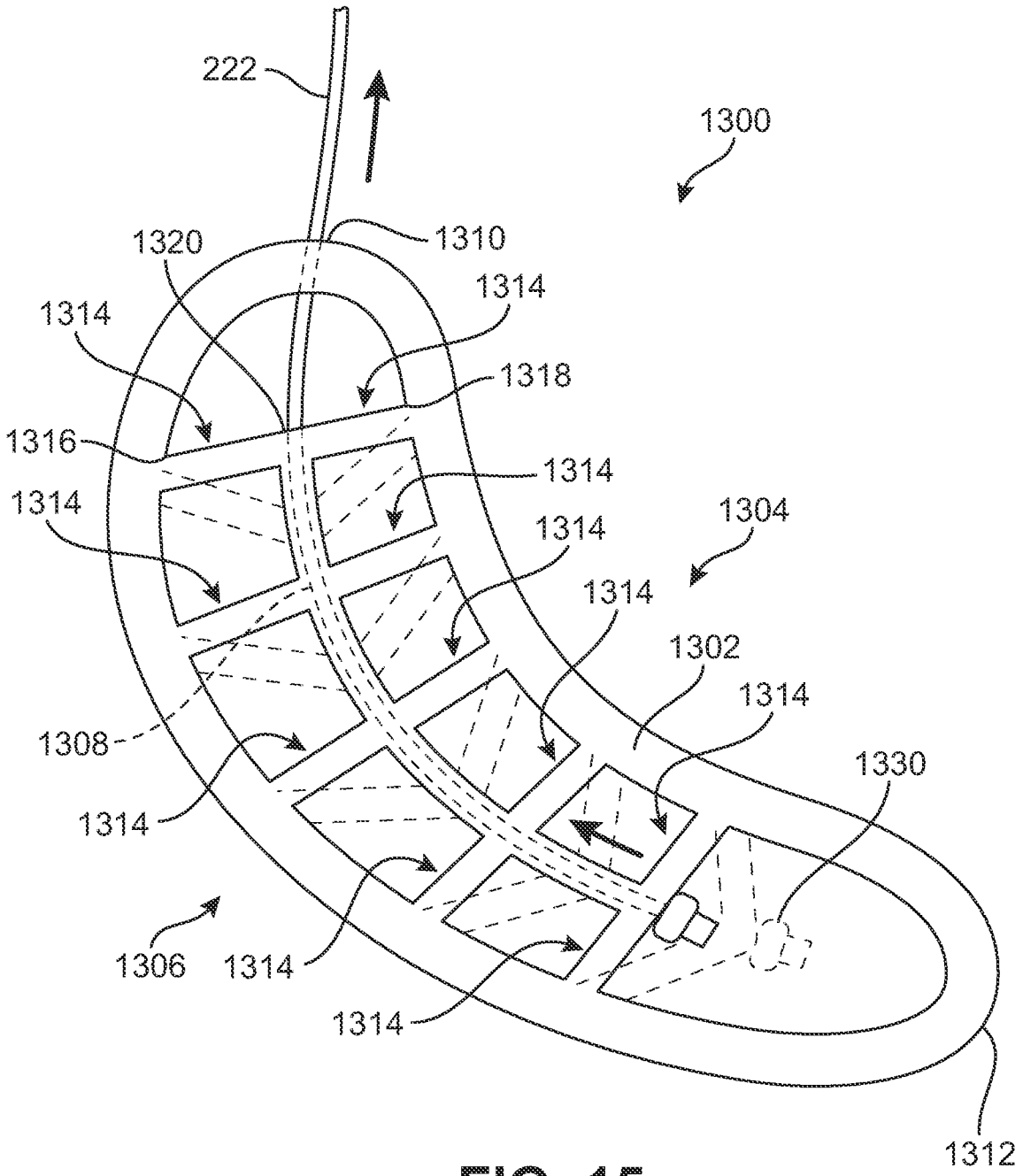
FIG. 15 is a schematic view of an alternate embodiment of a body structure for an adjustable tensioning system in a tightened configuration.

In some embodiments, other shapes, designs, and configurations for a body structure that may be used with an adjustable tensioning system, including lateral tensioning system 220 and/or medial tensioning system 230, may be provided. FIGS. 14 and 15 illustrate a loosened and a tightened configuration of an alternate embodiment of a body structure. Referring now to FIG. 14, in an alternate embodiment, a leaf body structure 1300 may be configured with an approximately leaf-like shape or arrangement. Leaf body structure 1300 may include an outer peripheral portion 1302 that extends around the perimeter of leaf body structure 1300 from a leading side 1304 to a trailing side 1306 and from a proximal end 1310 to a distal end 1312. In an exemplary embodiment, leaf body structure 1300 may include an interior channel 1308 disposed through the middle of a central portion 1320. Interior channel 1308 may be configured to receive a tensioning element, such as tensioning cable 222, described above. In one embodiment, tensioning cable 222 may be secured at one end of central portion 1320 near distal end 1312 using an anchor 1330. Anchor 1330 may be substantially similar to anchor 520, described above.

In an exemplary embodiment, leaf body structure 1300 may be provided with a shape or arrangement that is configured to flex as a whole, in contrast to comb body structure 226, described above, which includes specific flex portions having finger members that are configured to move between an open configuration and a fully closed configuration upon the application of tension to tensioning cable 222. In one embodiment, leaf body structure 1300 is configured to have a relaxed or loosened configuration corresponding to no tension or a negligible amount of tension applied by tensioning cable 222. In this embodiment, a plurality of leg members 1314 is disposed between central portion 1320 and outer peripheral portion 1302 along each of leading side 1304 and trailing side 1306.

In some embodiments, each individual leg member of plurality of leg members 1314 may be disposed at an angle with respect to central portion 1320 and outer peripheral portion 1302. In a relaxed or loosened configuration, shown here in FIG. 14, plurality of leg members 1314 may be disposed at an approximately acute angle with respect to central portion 1320 and at an approximately obtuse angle with respect to outer peripheral portion 1302. For example, a first vertex 1316 on trailing side 1306 and a second vertex 1318 on leading side 1304 may have approximately obtuse angles with respect to outer peripheral portion 1302. With this arrangement, leaf body structure 1300 may permit or allow a certain degree or amount of flexing to an inner liner and/or an article.

Referring now to FIG. 15, leaf body structure 1300 may be shown under applied tension from tensioning cable 222 to move leaf body structure 1300 from the relaxed or loosened configuration to a rigid or tightened configuration. As shown in this embodiment, the applied tension from tensioning cable 222 disposed within interior channel 1308 through central portion 1320 produces an opposing force against anchor 1330. The opposing force pulls central portion 1320 in a direction towards proximal end 1310. This movement of central portion 1320 towards proximal end 1310 causes each leg member of plurality of leg members 1314 to move from its original or initial position (shown in phantom in FIG. 15) to a flexed position. The flexed position causes plurality of leg members 1314 to be disposed at approximately a right angle with respect to both central portion 1320 and outer peripheral portion 1302.

For example, in this configuration, first vertex 1316 on trailing side 1306 and second vertex 1318 on leading side 1304 may be approximately perpendicular with respect to outer peripheral portion 1302. In contrast to the original or initial position, plurality of leg members 1314 in the flexed position increases the overall rigidity of leaf body structure 1300. With this arrangement, leaf body structure 1300 may be configured to resist or reduce a certain degree or amount of flexing to an inner liner and/or an article.

FIGS. 16-22 illustrate still further embodiments of configurations of a body structure for use with a tensioning system. In another embodiment shown in FIG. 16, a comb body structure 2700 includes a plurality of finger members 2702 that are spaced closer together along an outer edge 2704 of structure 2700 than along an inner portion 2706 of structure 2700. In other words, the widths of plurality of finger members 2702 may generally increase towards outer edge 2704. This may allow for substantially less flexing for body structure 2700 (see FIG. 17) as compared to embodiments where the plurality of finger members 2702 are spaced further apart at outer edge 2704 than at inner portion 2706 of structure 2700.

Figure 18:
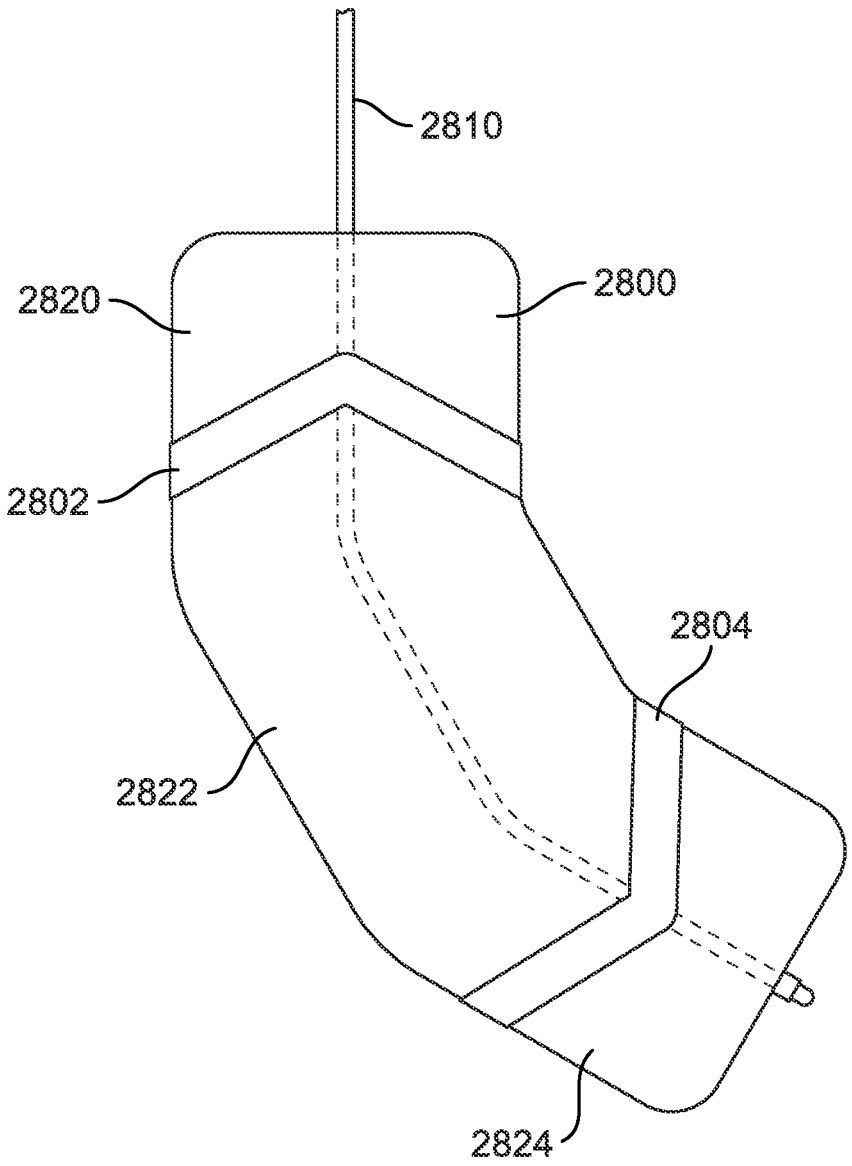
FIG. 18 is a schematic view of an alternative embodiment of a structure for an adjustable tensioning system in a loosened configuration.
Figure 19:
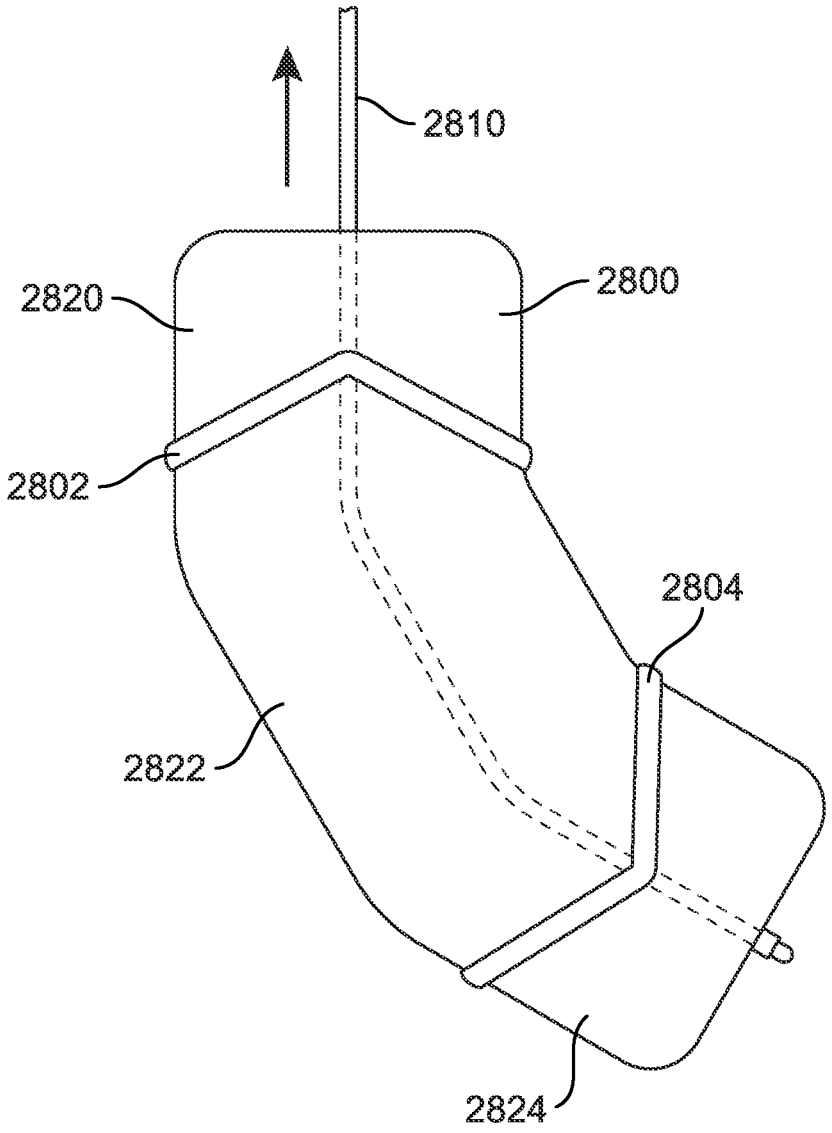
FIG. 19 is a schematic view of the alternative embodiment of FIG. 18 in an intermediate tightened configuration.
Figure 20:
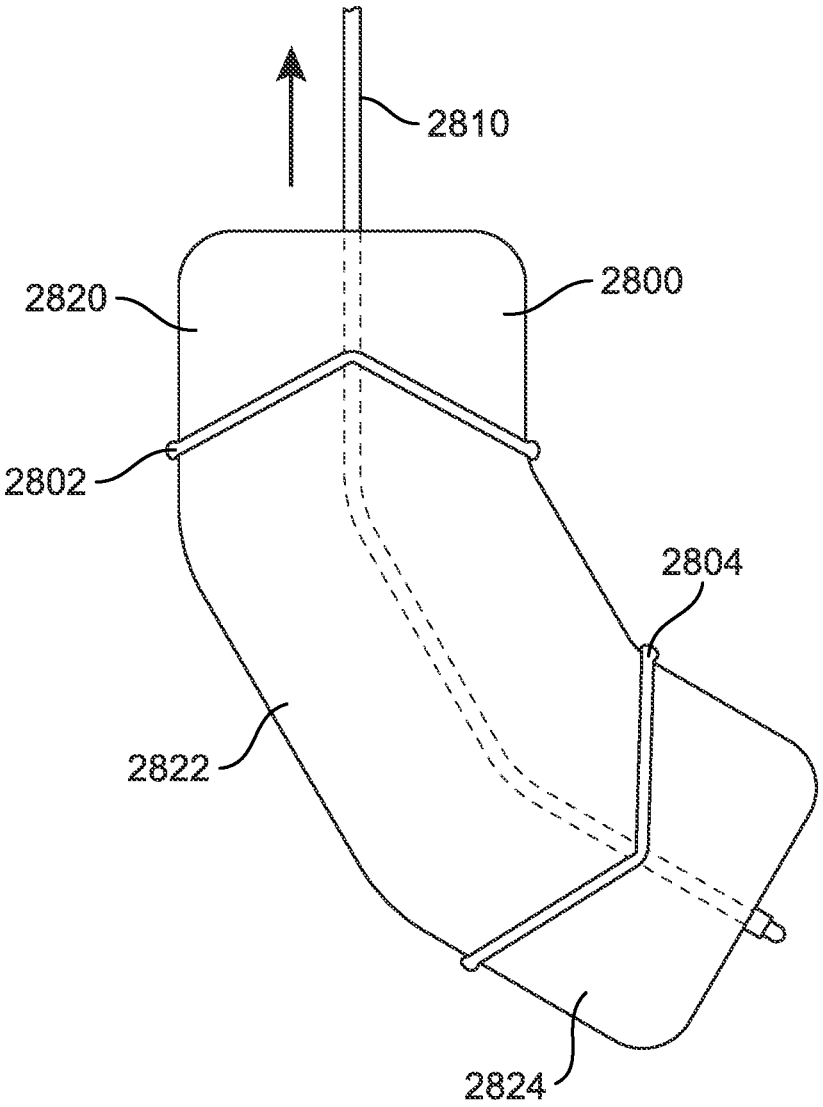
FIG. 20 is a schematic view of the alternative embodiment of FIG. 18 in a fully tightened configuration.

FIGS. 18 through 20 illustrate still another possible arrangement for a body structure 2800. Referring to FIGS. 18 through 20, body structure 2800 may comprise three base portions, including first base portion 2820, second base portion 2822 and third base portion 2824. First base portion 2820, second base portion 2822 and third base portion 2824 may be disjoint portions. Additionally, body structure 2800 can include a first connecting portion 2802 and a second connecting portion 2804. First connecting portion 2802 may connect first base portion 2820 and second base portion 2822, while second connecting portion 2804 may connect second base portion 2822 and third base portion 2824.

In different embodiments, the material properties of one or more portions of body structure 2800 could vary. In some cases, for example, base portions and connecting portions could have substantially different moduli of elasticity. For example, in some embodiments, first connecting portion 2802 and second connecting portion 2804 may have a substantially lower moduli of elasticity than first base portion 2820, second base portion 2822 and third base portion 2824. In other words, in some cases, the base portions could be stiffer than the connecting portions of body structure 2800. With this arrangement, first connecting portion 2802 and second connecting portion 2804 may stretch or otherwise elastically deform as forces are applied to body structure 2800. The overall stiffness of body structure 2800 may therefore vary according to the elastic properties of first connecting portion 2802 and second connecting portion 2804.

In order to increase the overall stiffness of body structure 2800, some embodiments can include provisions for compressing one or more connecting portions. For example, as seen in FIGS. 19 and 20, some embodiments can include a tensioning cable 2810 that can facilitate compression of the connecting portions, and thereby change the stiffness of body structure 2800. As seen in FIG. 19, increasing the tension of tensioning cable 2810 may act to pull adjacent portions of body structure 2810 closer together. In particular, as first connecting portion 2802 and second connecting portion 2804 may tend to compress under tension, thereby allowing first base portion 2820, second base portion 2822 and third base portion 2824 to move closer together. Furthermore, under compression, first connecting portion 2802 and second connecting portion 2804 may increase in stiffness relative to their uncompressed configurations (shown in FIG. 18). This acts to limit the relative movement between adjacent base portions and increase the overall stiffness of body structure 2800. By further increasing the tension of tensioning cable 2810, first connecting portion 2802 and second portion 2804 may be still further compressed as seen in FIG. 20, which acts to increase the overall stiffness of body structure 2800.

In different embodiments, the size and geometry of one or more connecting portions could vary. In some embodiments, first connecting portion 2802 and second connecting portion 2804 may have an angled geometry that is similar to corresponding brackets or chevrons. In other embodiments, however, the connecting portions could be configured with any other geometry. Likewise, the geometry of the base portions adjacent to the connecting portions could be varied accordingly in other embodiments. It will be understood that the geometry of the connecting portions (and corresponding parts of the base portions) could be varied to achieve different ranges of stiffness between the un-tensioned and fully tensioned states of body structure 2800.

Figure 21:
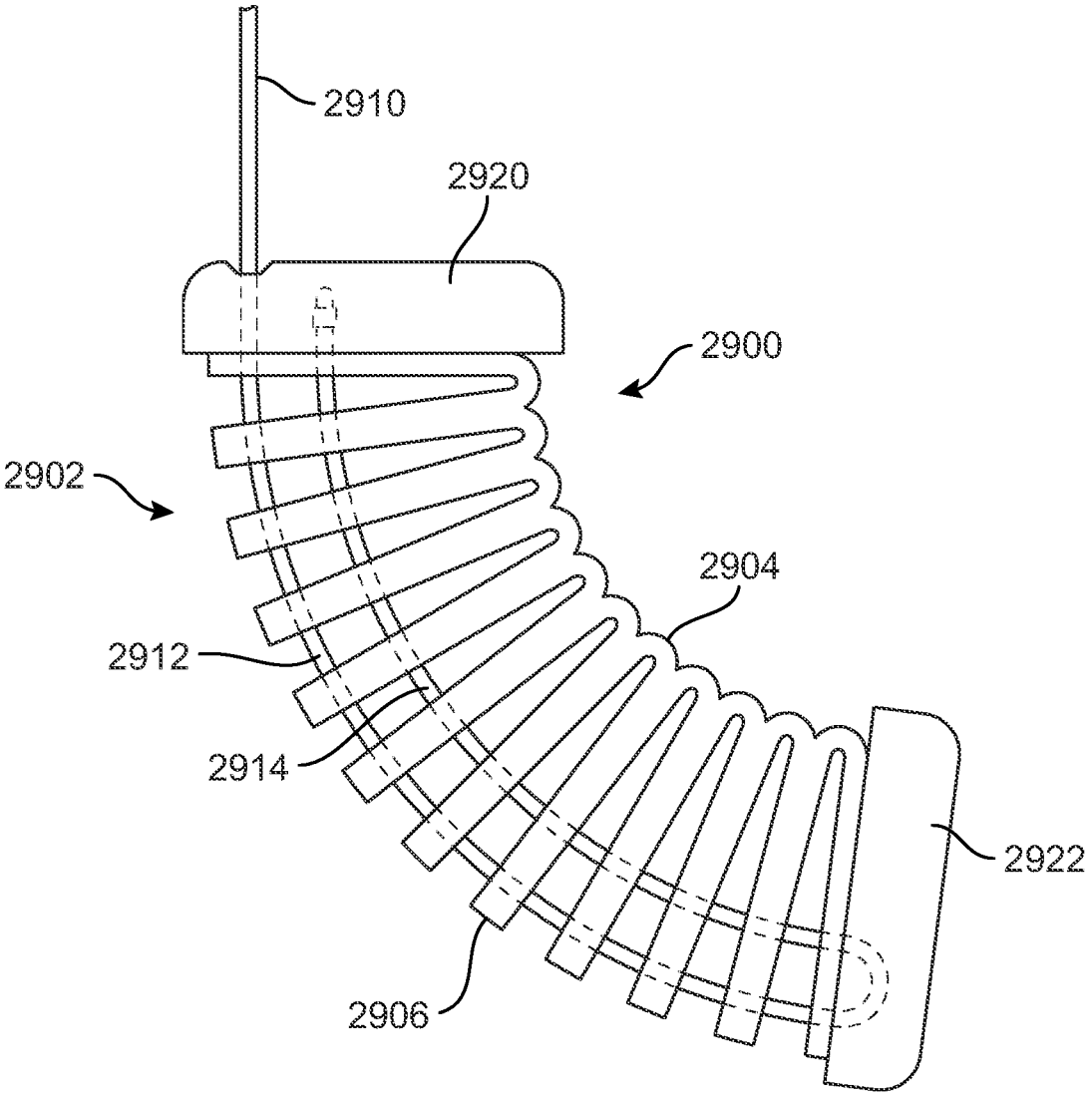
FIG. 21 is a schematic view of an alternative embodiment of a structure for an adjustable tensioning system in a loosened configuration.
Figure 22:
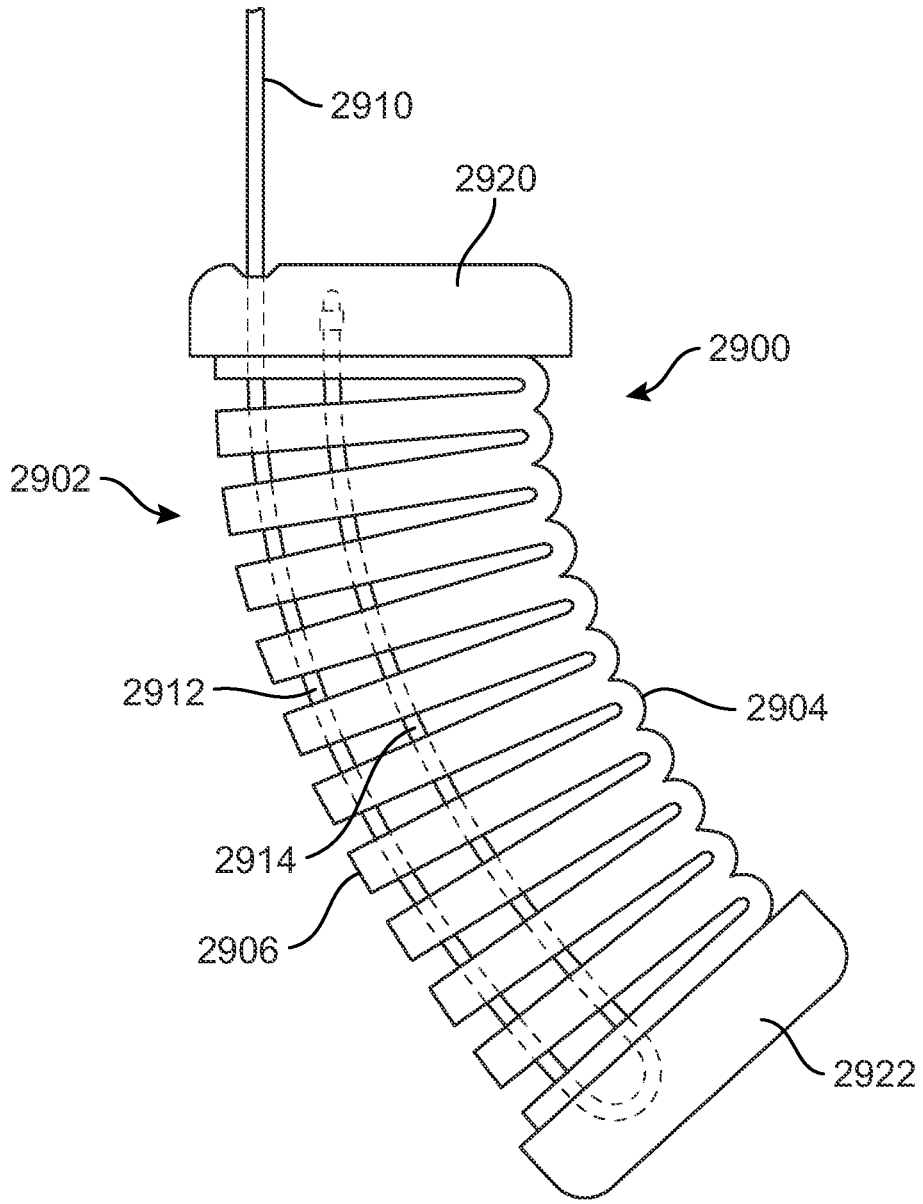
FIG. 22 is a schematic view of the alternative embodiment of FIG. 20 in the tightened configuration.

FIGS. 21 and 22 illustrate still another possible configuration for a comb body structure 2900. Referring to FIGS. 21 and 22, comb body structure 2900 comprises a plurality of finger members 2902 that are connected by a substantially narrow inner edge portion 2904. Thus, plurality of finger members 2902 may be more flexible relative to one another as compared to other configurations in which a plurality of finger members may be joined by a thicker inner edge portion of a comb body structure.

As seen in FIG. 21, this configuration may include a tensioning member 2910 that is disposed adjacent to outer edge portion 2906. In some embodiments, a first portion 2912 of tensioning member 2910 may be extend along outer edge portion 2906 from upper edge 2920 to lower edge 2922. From lower edge 2922, a second portion 2914 of tensioning member 2910 may extend back to upper edge 2920, where second portion 2914 may be anchored. This configuration for tensioning member 2910 may help improve the structural integrity of comb body structure 2900 by maintaining plurality of finger members 2902 in an approximately planar configuration.

Figure 31:
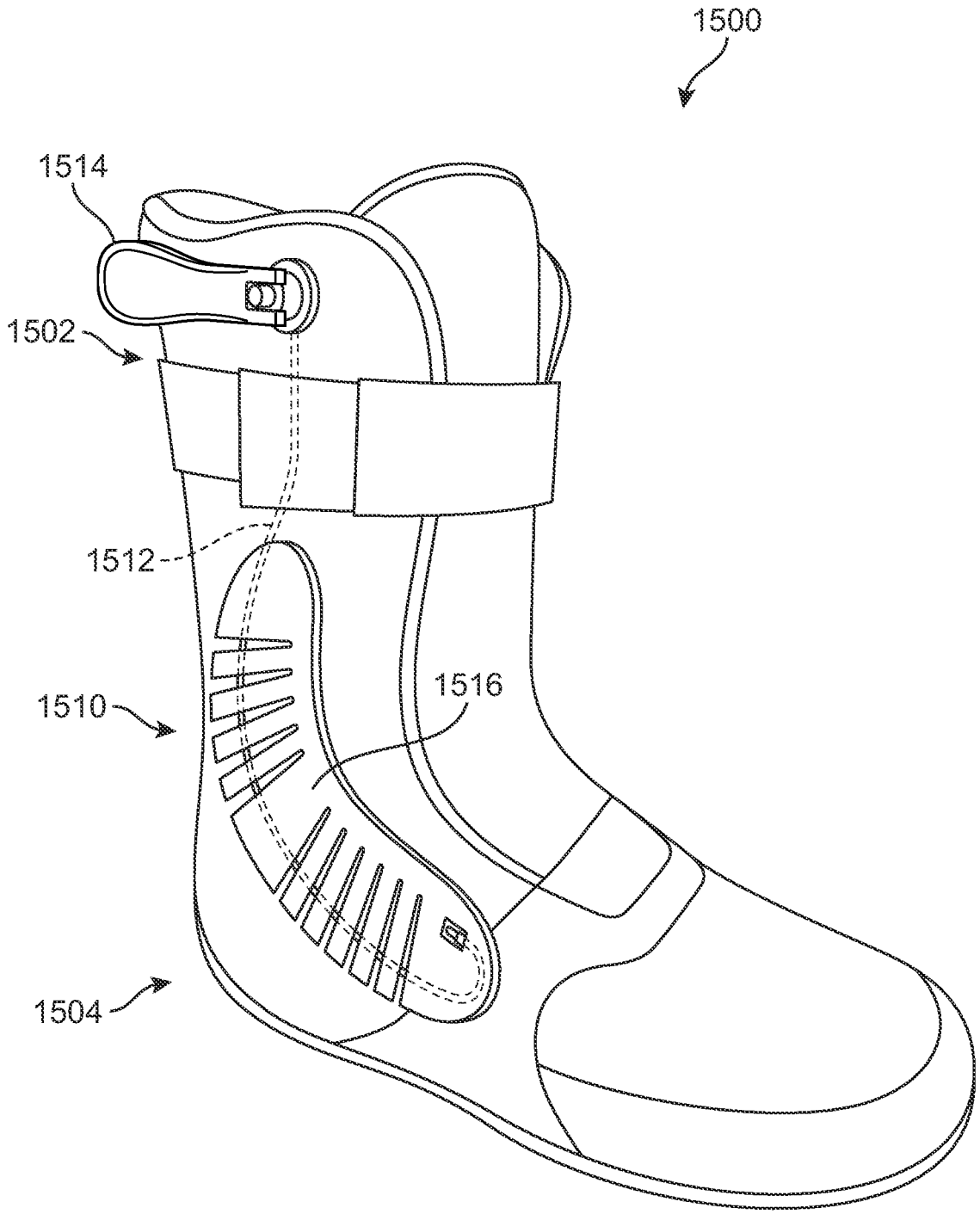
FIG. 31 is a schematic view of an adjustable tensioning system including an alternate embodiment of a tension control device using a cam mechanism.
Figure 32:
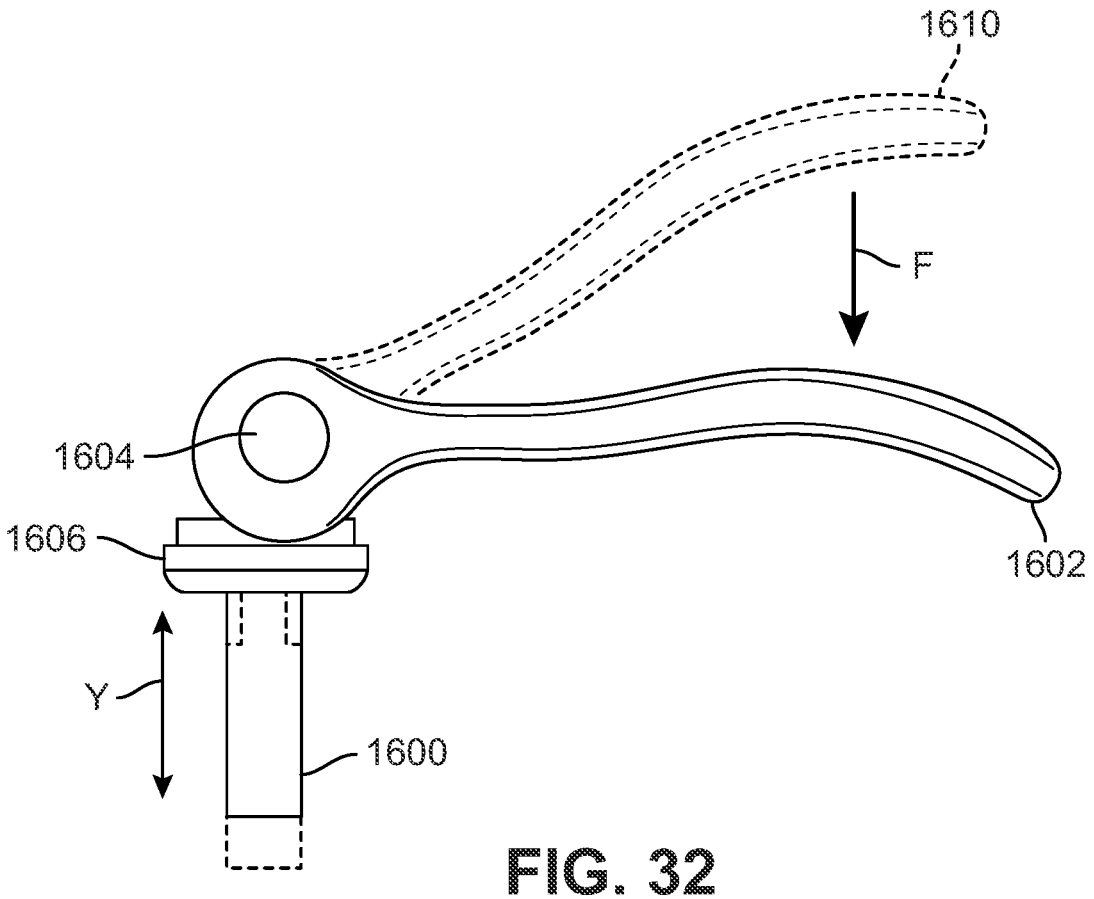
FIG. 32 is a schematic view of an alternate embodiment of a tension control device using a cam mechanism.
Figure 33:
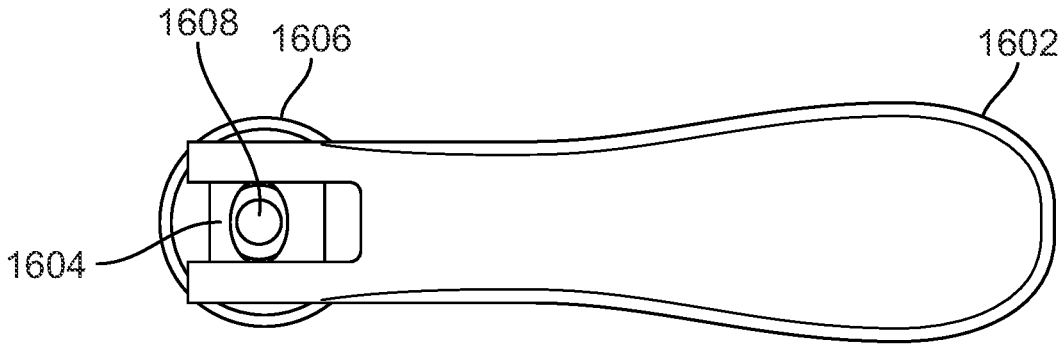
FIG. 33 is a top down schematic view of an alternate embodiment of a tension control device using a cam mechanism.

FIGS. 31 through 33 illustrate views of an alternative embodiment of a tensioning system that uses a cam-type mechanism to adjust the tension of a tensioning cable. In particular, FIG. 31 is an isometric schematic view of an inner liner 1500 having an upper liner portion 1502 and a lower liner portion 1504. In an exemplary embodiment, tensioning system 1510 including a tensioning cable 1512, a tension control device 1514, and a body structure 1516 is illustrated with tension control device 1514 disposed on upper liner portion 1502. FIGS. 32 and 33 illustrate portions of tension control device 1514 of tensioning system 1510.

Referring to FIGS. 31 through 33, tensioning system 1510 includes tensioning cable 1512 disposed through body structure 1516 and tension control device 1514 for adjusting the tension applied to tensioning cable 1512. Tensioning system 1510 may include a substantially similar arrangement of components as previous embodiments of tensioning systems described herein, including lateral tensioning system 220 and/or medial tensioning system 230. In this embodiment, tension control device 1514 comprises a spindle 1600, a handle 1602, a pin 1608 and a stopper 1606. Spindle 1600 may be attached to pin 1608, which may be further connected to handle 1602. Handle 1602 may be further mounted on an axle 1604. In some embodiments, pin 1608 may be connected to handle 1602 in such a manner that rotation about axle 1604 causes pin 1600 to move axially along the labeled y axis. Other embodiments, using different arrangements may also be used.

In some embodiments, handle 1602 may be configured to move from an open position to a closed or locked position. When handle 1602 is in an open position (shown has dotted position 1610) handle 1602 may be rotated along an axis defined by spindle 1600. In some embodiments this rotation may wind end portions of tensioning cable 1512 around spindle 1600. The rotation caused by this movement may cause the entire spindle 1600 to be moved upwards towards handle 1602, from the dotted initial position to the solid tightened position along the y axis. Once the user has tightened tensioning cable 1512 as desired, handle 1602 may be pressed into a closed or locked position, in the direction of arrow F.

In some embodiments, the axial movement presses spindle 1600 against a stopper 1606. The friction of spindle 1600 against stopper 1606 may prevent further spindle rotation, and the axial movement may also further tighten tensioning cable 1512 for a final snug fit.

In an alternate embodiment, spindle 1600 may be optional. In such an embodiment, tensioning cable 1512 may be directly attached to pin 1608. The rotation of handle 1602 about axle 1604 may cause pin 1608 to pull tensioning cable 1512 taut. Still other embodiments using a mechanical locking mechanism by themselves, or in combination with the spindle 1600, are envisioned.

The present embodiments described herein may be used by a wearer to adjust the stiffness of any one or more of a right boot, a left boot, as well as a lateral side and a medial side of each of a right boot and a left boot. In some embodiments, these provisions may further allow a user to adjust the stiffness of a tongue, as described above and disclosed in further detail in the Adjustable Stiffness Tongue case. With this arrangement, a wearer may adjust the stiffness of articles of footwear to provide for various snowboard riding conditions and/or styles of snowboard riding. In addition, a wearer may conveniently increase or decrease the amount or degree of stiffness of articles of footwear as desired while the articles are being worn without having to remove the articles to change the desired stiffness.

In addition, while the present embodiments illustrate adjustable tensioning systems disposed on the exterior of an inner liner of an article of footwear, it should be understood that in different embodiments, one or more of the adjustable tensioning systems described herein may be covered by a transparent, semi-transparent, or opaque covering layer to protect portions of the adjustable tensioning system, such as the body structure and tensioning element, from damage or merely for visual effect.

While various embodiments have been described, the description is intended to be exemplary, rather than limiting and it will be apparent to those of ordinary skill in the art that many more embodiments and implementations are possible. Accordingly, the embodiments are not to be restricted except in light of the attached claims and their equivalents. Also, various modifications and changes may be made within the scope of the attached claims.

What is claimed is:

1. An article of footwear comprising:

an upper;

a body structure extending along the upper between a first end and a second end and movable between a relaxed state having a first geometry and a flexed state having a second geometry different than the first geometry, the body structure including leg members extending from a central portion to a peripheral portion defining an outer periphery of the body structure; and a cable extending (i) into the body structure and (ii) in a direction from the first end toward the second end along the central portion between opposing leg members, the cable operable to move in a direction away from the second end toward the first end to move the body structure from the relaxed state to the flexed state.

2. The article of footwear of claim 1, wherein the body structure is disposed on an outer surface of the upper.

3. The article of footwear of claim 1, wherein the central portion defines an interior channel slidably receiving the cable therein.

4. The article of footwear of claim 1, wherein the leg members are disposed at a first angle relative to the central portion when the body structure is in the relaxed state and are disposed at a second angle relative to the central portion when the body structure is in the flexed state, the second angle being different than the first angle.

5. The article of footwear of claim 4, wherein the first angle is an acute angle and the second angle is approximately equal to ninety degrees (90°).

6. The article of footwear of claim 1, wherein the peripheral portion surrounds the central portion.

7. The article of footwear of claim 1, wherein the cable is anchored at a distal end of the central portion.

8. The article of footwear of claim 7, wherein the distal end of the central portion is spaced apart from the peripheral portion.

9. The article of footwear of claim 1, wherein the cable extends from an outer periphery of the body structure at the first end.

10. An article of footwear comprising:

an upper;

a body structure extending along the upper between a first end and a second end and movable between a relaxed state having a first rigidity and a flexed state having a second rigidity different than the first rigidity, the body structure including leg members extending from a central portion to a peripheral portion defining an outer periphery of the body structure; and a cable extending (i) into the body structure and (ii) in a direction from the first end toward the second end along the central portion between opposing leg members, the cable operable to move in a direction away from the second end toward the first end to move the body structure from the relaxed state to the flexed state.

11. The article of footwear of claim 10, wherein the body structure is disposed on an outer surface of the upper.

12. The article of footwear of claim 10, wherein the central portion defines an interior channel slidably receiving the cable therein.

13. The article of footwear of claim 10, wherein the leg members are disposed at a first angle relative to the central portion when the body structure is in the relaxed state and are disposed at a second angle relative to the central portion when the body structure is in the flexed state, the second angle being different than the first angle.

14. The article of footwear of claim 13, wherein the first angle is an acute angle and the second angle is approximately equal to ninety degrees (90°).

15. The article of footwear of claim 10, wherein the peripheral portion surrounds the central portion.

16. The article of footwear of claim 10, wherein the cable is anchored at a distal end of the central portion.

17. The article of footwear of claim 16, wherein the distal end of the central portion is spaced apart from the peripheral portion.

18. The article of footwear of claim 10, wherein the cable extends from an outer periphery of the body structure at the first end.

* * * * *